United States Patent [19]

Kato et al.

[11] Patent Number: 4,971,871

[45] Date of Patent: Nov. 20, 1990

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 303,508

[22] Filed: Jan. 30, 1989

[30] Foreign Application Priority Data

Jan. 29, 1988 [JP] Japan ..... 63-17421
Feb. 3, 1988 [JP] Japan ..... 63-22062

[51] Int. Cl.[5] ..... G03G 5/087
[52] U.S. Cl. ..... 430/49; 430/87; 430/96
[58] Field of Search ..... 430/49, 87, 96

[56] References Cited

U.S. PATENT DOCUMENTS 4,210,081 7/1980 Croker ..... 430/524
4,828,952 5/1989 Kato et al. ..... 430/96

*Primary Examiner*—John L. Goodrow
*Attorney, Agent, or Firm*—Sughrue, Mion, Zinn, Macpeak & Seas

[57] ABSTRACT

An electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one hydrophilic group selected from a thiol group, a phosphono group, an amino group, and a sulfo group upon decomposition and at least one of (B) a heat-curable and photo-curable resin and (C) a cross-linking agent. The printing plate precursor provides a printing plate exhibiting excellent resistance to background stains and printing durability.

16 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor, and, more particularly, to an improvmed resin binder forming a photoconductive layer of a lithographic printing plate precursor.

BACKGROUND OF THE INVENTION

A number of offset printing plate precursors for directly producing printing plates have hitherto been proposed and put into practical use. Widely employed among them is a system in which a photoreceptor comprising a conductive support having provided thereon a photoconductive layer mainly comprising photoconductive particles, e.g., zinc oxide, and a resin binder is subjected to an ordinary electrophotographic processing to form a highly lipophilic toner image thereon and the surface of the photoreceptor is then treated with an oil-desensitizing solution, referred to as an etching solution, to selectively render non-image areas hydrophilic, and thereby obtain an offset printing plate.

Requirements of offset printing plate precursors for obtaining satisfactory prints are such that: an original should be reproduced faithfully on the photoreceptor; the surface of a photoreceptor has affinity with an oil-desensitizing solution so as to render non-image areas sufficiently hydrophilic, while, at the same time, having water resistance; and that a photoconductive layer having an image formed thereon is not released during printing and is well receptive to dampening water so that the non-image areas hold the hydrophilic properties enough to be free from stains even on printing a large number of prints.

It is known that these performance properties of the printing plate precursors are influenced by the ratio of zinc oxide to resin binder in the photoconductive layer. For example, as the ratio of resin binder to zinc oxide particles becomes small, oil-desensitization of the surface of the photoconductive layer is increased to reduce background stains, but, in turn, the internal cohesion of the photoconductive layer per se is weakened, resulting in reduction of printing durability due to insufficient mechanical strength. On the other hand, as the proportion of the resin binder increases, printing durability is improved, but background staining tends to become conspicuous With respect to background staining, while it is a phenomenon associated with the degree of oil-desensitization achieved, it has been elucidated that the oil-desensitization of the photoconductive layer surface depends not only on the zinc oxide/resin binder ratio in the photoconductive layer, but also greatly on the kind of the resin binder used.

Resin binders which have been conventionally known include silicone resins (see JP-B-34-6670, the term "JP-B" as used herein means an "examined published Japanese Patent application"), styrene-butadiene resins (see JP-B-35-1950), alkyd resins, maleic acid resins, polyamides (see JP-B-35-11219), vinyl acetate resins (see JP-B-41-2425), vinyl acetate copolymer resins (see JP-B-41-2426), acrylic resins (see JP-B-35-11216), acrylic,ester copolymer resins (see JP-B-35-11219, 36-8510, and 41-13946), etc. However, electrophotographic light-sensitive materials using these known resins suffer from several disadvantages, such as low charging characteristics of the photoconductive layer; poor quality of a reproduced image, particularly dot reproducibility or resolving power; low sensitivity to exposure; insufficient oil-desensitization attained by oil-desensitization for use as an offset master, which results in background stains on prints when used for offset printing; insufficient film strength of the light-sensitive layer, which causes release of the light-sensitive layer during offset printing, failing to obtain a large number of prints; susceptibility of image quality to influences of environment at the time of electrophotographic image formation, such as high temperatures and high humidities; and the like.

For the particular use as an offset printing plate precursor, formation of background stains due to insufficient oil-desensitization presents a serious problem. In order to solve this problem, various resins have been proposed as binders for zinc oxide, including a resin having a molecular weight of from $1.8\times10^4$ to $1\times10^5$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit having a substituent having a carboxylic group at least 7 atoms distant from the ester linkage as disclosed in JP-A-53-54027 (the term "JP-A" as used herein means an "unexamined published Japanese patent application"); a tetra- or pentamer containing an acrylic acid unit and a hydroxyethyl (meth)acrylate unit as disclosed in JP-A-54-20735 and 57-202544; a terpolymer containing a (meth)acrylic ester unit having an alkyl group having from 6 to 12 carbon atoms as a substituent and a vinyl monomer containing a carboxylic acid group as disclosed in JP-A-58-68046; and the like.

Nevertheless, evaluations of these resins proposed for improving oil-desensitization revealed that none of them is fully satisfactory in terms of stain resistance and printing durability.

The use of resins having a functional group capable of forming a hydrophilic group on decomposition as a binder has been studied. For example, there have been proposed resins having a functional group capable of forming a hydroxyl group on decomposition as disclosed in JP-A-62-195684, 62-210475, and 62-210476, and resins having a functional group capable of forming a carboxyl group on decomposition as disclosed in JP-A-62-21269.

These functional group-containing resins form a hydrophilic group upon being hydrolyzed or hydrogenolyzed with an oil-desensitizing solution or dampening water used during printing. It has been reported that use of these resins as a binder of a lithographic printing plate precursor can avoid various problems associated with use of resins containing a hydrophilic group from the first, such as deterioration of surface smoothness and electrophotographic characteristics, which seem ascribable to the strong interaction between the hydrophilic group and the surface of the photoconductive zinc oxide particles. It has also been expected that the hydrophilic properties of the non-image areas attained by an oil-desensitizing solution can be enhanced by the hydrophilic group formed by decomposition of the resin so that a clear distinction can be made between the lipophilic image area and the hydrophilic non-image area. Adhesion of a printing ink onto the non-image areas during printing can thus be prevented, thereby making it possible to obtain a large number of prints having a clear image free from background stains.

However, the above-described functional group-containing resins capable of forming a hydrophilic group are still unsatisfactory in resistance to background stain and printing durability. In particular, it has turned out that the resin becomes water-soluble as its amount is increased for further improving hydrophlic properties of the non-image areas, thus impairing durability of the hydrophilic properties. Hence, there is a demand to develop a technique by which the hydrophilic properties of the non-image areas can be assured while still lasting long. Namely, it has been keenly desired to establish a technique in which the effect to improve hydrophilic properties can be retained or enhanced even if the proportion of the resin containing a hydrophilic group-forming functional group in the total resin binder is decreased, or a large number of clear prints can be obtained without suffering from background stains even if the printing conditions are made more strict due to an increase of a printing machine in size or a variation of printing pressure.

SUMMARY OF THE INVENTION

One object of this invention is to provide a lithographic printing plate precursor which reproduces an image faithful to an original, exhibits satisfactory hydrophilic properties on the non-image areas thereby forming no background stains, satisfactory surface smoothness and electrophotographic characteristics, and excellent printing durability.

Another object of this invention is to provide a lithographic printing plate precursor which is not influenced by a variation of environmental conditions of electrophotographic processing and exhibits excellent preservability before processing.

It has now been found that the above objects can be accomplished by an electrophotographic lithographic printing plate precursor obtained from an electrophotographic photoreceptor comprising a conductive support having provided thereon at least one photoconductive layer containing photoconductive zinc oxide and a resin binder, wherein said resin binder comprises (A) at least one resin containing at least one functional group capable of forming at least one of a thiol group, a phosphono group, an amino group and/or a sulfo group upon decomposition and at least one of (B) a heat-curable or a photo-curable resin and (C) a crosslinking agent.

The feature of the present invention lies in the use of the resin (A) containing a functional group capable of forming at least one of a thiol group, a phosphono group, an amino group, and a sulfo group on decomposition in combination with the heat-curable or photo-curable resin (B) and/or crosslinking agent (C) which forms a crosslinked structure between polymer components.

DETAILED DESCRIPTION OF THE INVENTION

The resin which can be used in the present invention as a binder contains (A) at least one resin containing at least one functional group capable of forming one or more hydrophilic groups selected from the group consisting of a thiol group, a phosphono group, an amino group, and a sulfo group upon decomposition (hereinafter sometimes referred to as hydrophilic group-forming functional group-containing resin and (B) a heat-curable or photo-curable resin and/or (C) a crosslinking agent.

The resin (A) containing a functional group forming at least one thiol group on decomposition (hereinafter referred to as thiol-forming functional group-containing resin) preferably includes a resin containing at least one functional group represented by formula (I):

$$-S-L^A \qquad (I)$$

wherein $L^A$ represents

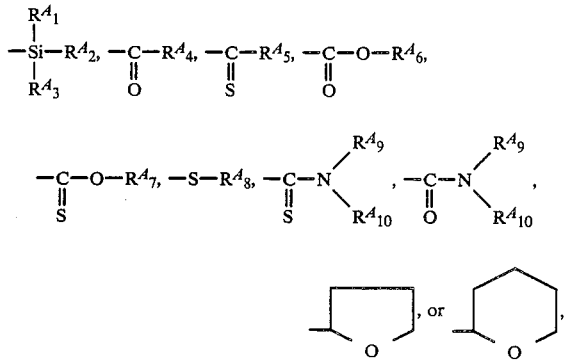

wherein $R^{A}_1$, $R^{A}_2$, and $R^{A}_3$, which may be the same or different, each represents a hydrocarbon group or —O—$R^{A'}$, wherein $R^{A'}$ represents a hydrocarbon group; and $R^{A}_4$, $R^{A}_5$, $R^{A}_6$, $R^{A}_7$, $R^{A}_8$, $R^{A}_9$, and $R^{A}_{10}$ each represents a hydrocarbon group.

In formula (I), when $L^A$

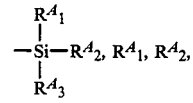

and $R^{A}_3$ (which may be the same or different) each preferably represents a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, fluorobenzyl, chlorobenzyl, methylbenzyl, methoxybenzyl), a substituted or unsubstituted aromatic group (e.g., phenyl, naphthyl, chlorophenyl, tolyl, methoxyphenyl, methoxycarbonylphenyl, dichlorophenyl), or —O—$R^{A'}$, wherein $R^{A'}$ represents a hydrocarbon group, and more specifically includes the hydrocarbon groups as above recited for $R^{A}_1$, $R^{A}_2$, and $R^{A}_3$.

When $L^A$ is

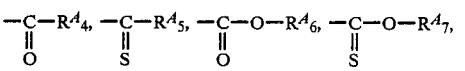

or —S—$R^{A}_8$, $R^{A}_4$, $R^{A}_5$, $R^{A}_6$, $R_{A7}$, and $R^{A}_8$ preferably represents a substituted or unsubstituted straight chain or branched alkyl group having from 1 to 12 carbon atoms (e.g., methyl, trichloromethyl, trifluoromethyl, methoxymethyl, ethyl, propyl, n-butyl, hexyl, 3-chloropropyl, phenoxymethyl, 2,2,2-trifluoroethyl, t-butyl, hexafluoroisopropyl, octyl, decyl), a substituted or unsubstituted aralkyl group having from 7 to 9 carbon atoms (e.g., benzyl, phenethyl, methylbenzyl, trimethylbenzyl, heptamethylbenzyl, methoxybenzyl), or a substituted or unsubstituted aryl group having from 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

When $L^A$ is

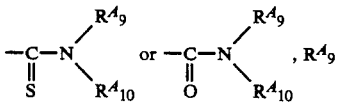

and $R^A{}_{10}$ ( which may be the same or different) each preferably represents any of the substituents recited above as preferred examples of $R^A{}_4$, $R^A{}_5$, $R^A{}_6$, $R^A{}_7$, and $R^A{}_8$.

The thiol-forming functional group-containing resin further includes, preferably, a resin containing at least one thiirane ring represented by formula (II) or (III):

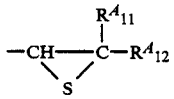

(II)

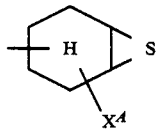

(III)

In formula (II), $R^A{}_{11}$ and $R^A{}_{12}$, which may be the same or different, each represents a hydrogen atom or a hydrocarbon group, and preferably a hydrogen atom or the substituent recited as preferred examples of $R^A{}_4$, $R^A{}_5$, $R^A{}_6$, and $R^A{}_7$.

In formula (III), $X^A$ represents a hydrogen atom or an aliphatic group. The aliphatic group preferably includes an alkyl group having from 1 to 6 carbon atoms (e.g., methyl, ethyl, propyl, butyl).

The thiol-forming functional group-containing resin (A) furthermore includes preferably a resin containing at least one heterocyclic group containing a sulfur atom as represented by formula (IV):

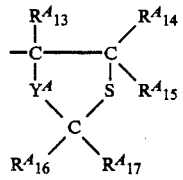

(IV)

wherein $Y^A$ represents an oxygen atom or —NH—; $R^A{}_{13}$, $R^A{}_{14}$, $R^A{}_{15}$, which may be the same or diffferent, each represents a hydrogen atom or a hydrocarbon group, and preferably a hydrogen atom or the substituent recited above as preferred examples of $R^A{}_4$, $R^A{}_5$, $R^A{}_6$, and $R^A{}_7$; $R^A{}_{16}$ and $R^A{}_{17}$, which may be the same or different, each represents a hydrogen atom, a hydrocarbon group, or —O—$R^{A''}$, wherein $R^{A''}$ represents a hydrocarbon group, and preferably the substituent recited above as preferred examples of $R^A{}_1$, $R^A{}_2$, $R^A{}_3$.

The thiol-forming functional group-containing resin (A) furthermost includes a resin containing at least one functional group in which at least two thiol groups sterically spaced close to each other are protected with one protective group.

The functional group having at least two thiol groups sterically spaced cloth to each other protected with one protective group includes those represented by formulae (V), (VI), and (VII):

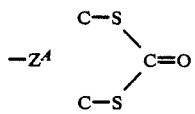

(V)

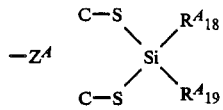

(VI)

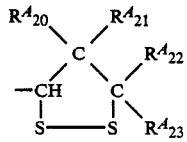

(VII)

In formulae (V) and (VI), $Z^A$ represents a carbon-carbon bond which may contain a hetero atom or a chemical bond directly connecting the C-S bonds, provided that the number of atoms between two sulfur atoms is 4 or less, or either one of the $Z^A$ . . . C bond represents a chemical bond, for example, to form a structure

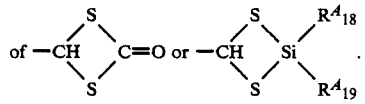

In formula (VI), $R^A{}_{18}$ and $R^A{}_{19}$, which may be the same or different, each represents a hydrogen atom, a hydrocarbon group, or —O—$R^{A''}$, wherein $R^{A''}$ represents a hydrocarbon group.

In formula (VI), $R^A{}_{18}$ and $R^A{}_{19}$ (which may be the same or different) each preferably represents a hydrogen atom, a substituted or unsubstituted alkyl group having from 1 to 12 carbon atoms (e.g., methyl, ethyl, propyl, butyl, hexyl, 2-methoxyethyl, octyl), a substituted or unsubstituted aralkyl group having from 7 to 9 carbon atoms (e.g., benzyl, phenethyl, methylbenzyl, methoxybenzyl, chlorobenzyl), a substituted or unsubstituted alicyclic group having from 5 to 7 carbon atoms (e.g., cyclopentyl, cyclohexyl), a substituted or unsubstituted aryl group (e.g., phenyl, chlorophenyl, methoxyphenyl, methylphenyl, cyanophenyl), or —O—$R^{A''}$, wherein $R^{A''}$ has the same meaning as the hydrocarbon groups as represented by $R^A{}_{18}$ or $R^A{}_{19}$.

In Formula (VII), $R^A{}_{20}$, $R^A{}_{21}$, $R^A{}_{22}$, and $R^A{}_{23}$ (which may be the same or different) each represents a hydrogen atom or a hydrocarbon group, and preferably a hydrogen atom or the hydrocarbon group recited above as preferred examples of $R^A{}_{18}$ and $R^A{}_{19}$.

The resin containing at least one of the functional groups represented by formulae (I) to (VII) can be prepared by a process comprising protecting a thiol group in a polymer with a protective group through high-molecular reaction, or a process comprising polymerizing one or more monomers containing one or at least two thiol groups previously protected with a protective group or copolymerizing such a monomer with other copolymerizable monomers.

It is difficult to directly polymerize a thiol-containing monomer because a thiol group inhibits radical polymerization. Therefore, the thiol-containing polymer can be prepared by a process comprising introducing a thiol group into a polymer by polymer reaction or a process comprising polymerizing a monomer having thiol groups protected so as to have a structure of the functional group according to the present invention, an isothiuronium salt, a Bunte salt (S-alkylthiosulfate), etc., and then decomposing the polymer for deprotection.

The latter process comprising polymerizing a monomer containing any of the functional groups of formulae (I) to (VII) is preferred to the former process from reasons that the thiol-protected functional group in the resulting polymer can be controlled arbitrarily; that the resulting polymer is free from contamination with impurities; and that polymerization cannot be performed unless the thiol group in a monomer is protected.

For conversion of one or at least two thiol groups to a functional group in which the thiol group(s) is or are protected, reference can be made, e.g., in Y. Iwakura and K. Kurita, *Han-nosei Kobunshi,* 230–237, Kodansha (1977), Nippon Kagakukai (ed.), *Shin Jikken Kagaku Koza,* Vol. 14, "Yuki Kagobutsu no Gosei to Han-no (III)", Ch. 8, 1700–1713, Maruzen K. K. (1978), J. F. W. McOmie, *Protective Groups in Organic Chemistry,* Ch. 7, Plenum Press (1973), and S. Patai, *The Chemistry of the Thiol Group Part* 2, Chs. 12 and 14, John Wiley & Sons (1974).

The monomer containing one or at least two of thiol groups protected with a protective group, for example, the functional groups represented by formulae (I) to (VII), can be obtained by a process wherein a compound having a polymerizable double bond and at least one thiol group is reacted to thereby convert the thiol group(s) to any of the functional groups of formulae (I) to (VII) or a process wherein a compound containing any of the functional groups of formulae (I) to (VII) is reacted with a compound having a polymerizable double bond.

Specific but non-limiting examples of a monomer unit containing any of the functional groups of formulae (I) to (VII) are shown below:

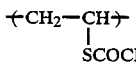
(1)

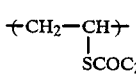
(2)

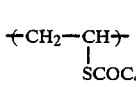
(3)

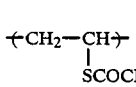
(4)

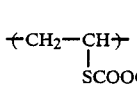
(5)

-continued

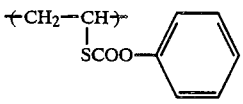
(6)

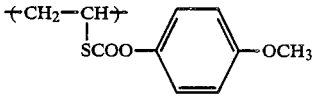
(7)

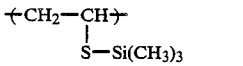
(8)

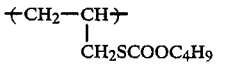
(9)

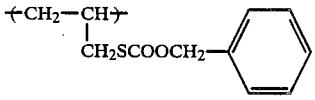
(10)

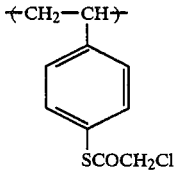
(11)

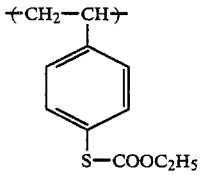
(12)

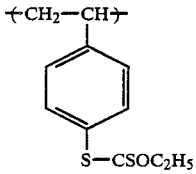
(13)

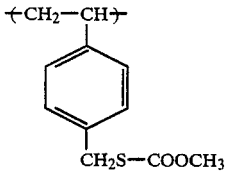
(14)

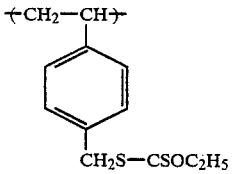
(15)

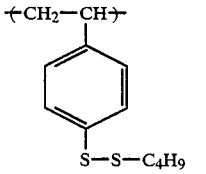
(16)

-continued (17)

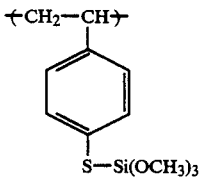

(18)

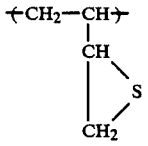

(19)

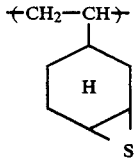

(20)

$$\text{-}(CH_2-CH)\text{-}$$
$$COO(CH_2)_2S-COCH_2Cl$$

(21)

$$\text{-}(CH_2-C(CH_3))\text{-}$$
$$COO(CH_2)_2S-COOC_2H_5$$

(22)

$$\text{-}(CH_2-C(CH_3))\text{-}$$
$$COO(CH_2)_2S-CSOC_2H_5$$

(23)

$$\text{-}(CH_2-C(CH_3))\text{-}$$
$$COO(CH_2)_2S-CS-N(CH_3)_2$$

(24)

$$\text{-}(CH_2-C(CH_3))\text{-}$$
$$COOCH_2CHCH_2$$
$$S$$

(25)

$$\text{-}(CH_2-CH)\text{-}$$
$$COO(CH_2)_2S-Si(CH_3)_3$$

(26)

$$\text{-}(CH_2-C(CH_3))\text{-}$$
$$COOCH_2CHCH_2CH_2S-CSOC_2H_5$$
$$S-CSOC_2H_5$$

(27)

$$\text{-}(CH_2-CH)\text{-}$$
$$COO(CH_2)_2SCOOC_4H_9$$

(28)

$$\text{-}(CH_2-C(CH_3))\text{-}$$
$$CONH(CH_2)_4SCOOC_4H_9$$

-continued (29)

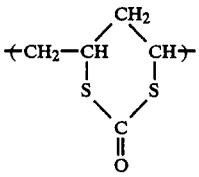

(30)

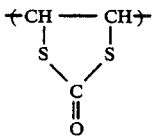

(31)

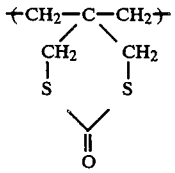

(32)

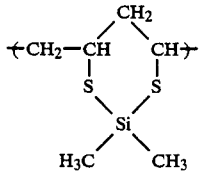

(33)

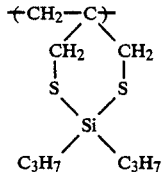

(34)

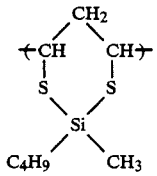

(35)

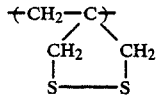

(36)

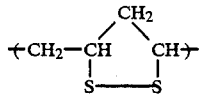

(37)

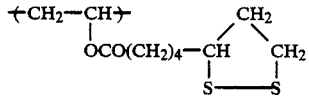

(38)

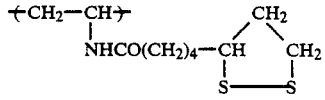

-continued (39)

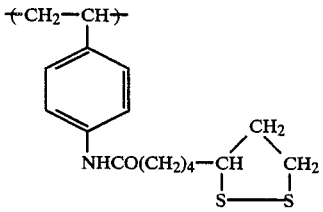

(40)

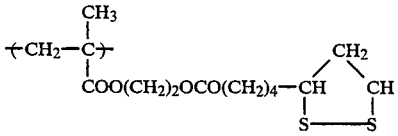

(41)

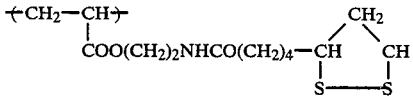

(42)

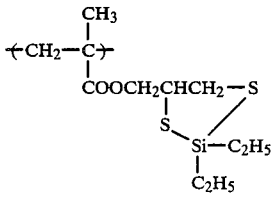

(43)

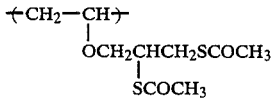

(44)

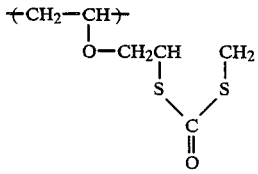

(45)

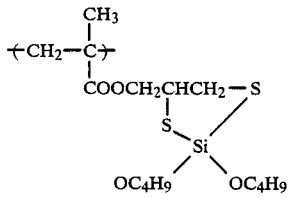

(46)

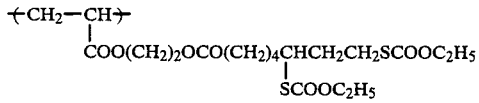

(47)

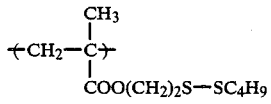

(48)

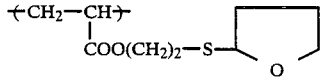

-continued (49)

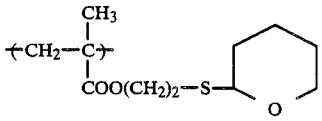

(50)

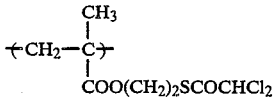

(51)

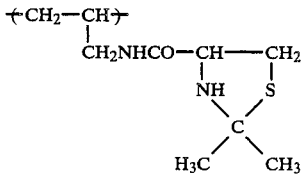

(52)

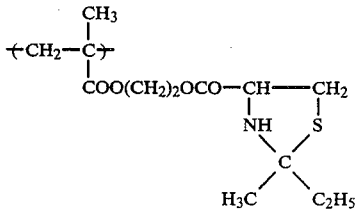

(53)

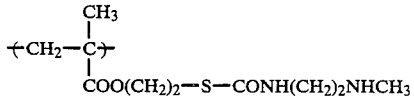

The resin (A) containing at least one functional group capable of forming at least one phosphono group on decomposition is described below. The phosphono group herein referred to includes those represented by formula (VIII) or (IX):

(VIII)

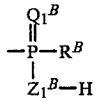

(IX)

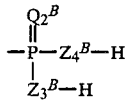

In formula (VIII), $R^B$ represents a hydrocarbon group or $—Z^B{}_2—R^{B'}$, wherein $R^{B'}$ represents a hydrocarbon group, and $Z^B{}_2$ represents an oxygen atom or a sulfur atom; $Z^B{}_1$ represents an oxygen atom or a sulfur atom; and $Z^B{}_1$ represents an oxygen atom or a sulfur atom.

In formula (IX), $Q^B{}_2$, $Z^B{}_3$, and $Z^B{}_4$ each represents an oxygen atom or a sulfur atom.

$R^B$ preferably represents a substituted or unsubstituted straight chain or branched alkyl group having from 1 to 12 carbon atoms (e.g., methyl, ethyl, propyl, butyl, pentyl, hexyl, octyl, decyl, 2-methoxyethyl, 3-methoxypropyl, 2-ethoxyethyl), a substituted or unsubstituted alicyclic group (e.g., cyclopentyl, cyclohexyl), a substituted or unsubstituted aralkyl group having from 7 to 12 carbon atoms (e.g., benzyl, phenethyl, methylbenzyl, methoxybenzyl, chlorobenzyl), a substituted or unsubstituted aromatic group (e.g., phenyl, chlorophenyl, tolyl, xylyl, methoxyphenyl, methoxycarbonylphenyl, dichlorophenyl), or $-Z^{B}_{2}-R^{B'}$, wherein $Z^{B}_{2}$ represents an oxygen atom or a sulfur atom, and $R^{B'}$ represents a hydrocarbon group, and specifically the substituent recited above as examples of $R^{B}$.

$Q^{B}_{1}$, $Q^{B}_{2}$, $Z^{B}_{1}$, $Z^{B}_{3}$, and $Z^{B}_{4}$ each represents an oxygen atom or a sulfur atom.

The functional group capable of forming the phosphono group represented by formula (VIII) or (IX) includes those represented by formula (X) and/or (XI):

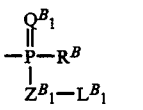

(X)

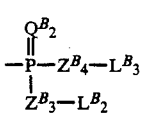

(XI)

In formulae (X) and (XI), $Q^{B}_{1}$, $Q^{B}_{2}$, $Z^{B}_{1}$, $Z^{B}_{3}$, $Z^{B}_{4}$, and $R^{B}$ are as defined in formulae (VIII) and (XI); $L^{B}_{1}$, $L^{B}_{2}$, and $L^{B}_{3}$ each represents

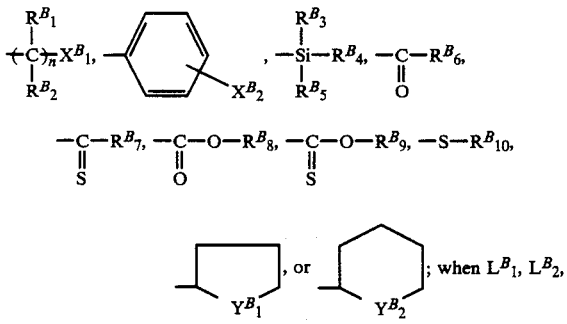

and $L^{B}_{3}$ each represents

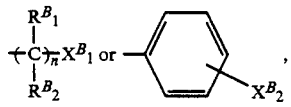

$R^{B}_{1}$ and $R^{B}_{2}$, which may be the same or different, each represents a hydrogen atom, a halogen atom (e.g., chlorine, bromine, fluorine), or a methyl group; $X^{B}_{1}$ and $X^{B}_{2}$ each represents an electron attracting substituent, and preferably a halogen atom (e.g., chlorine, bromine, fluorine), —CN, $-CONH_2$, $-NO_2$, or $-SO_2R^{B''}$, wherein $R^{B''}$ represents a hydrocarbon group (e.g., methyl, ethyl, propyl, butyl, hexyl, benzyl, phenyl, tolyl, xylyl, mesityl); n represents 1 or 2, wherein when $X^{B}_{1}$ represents a methyl group, $R^{B}_{1}$ and $R^{B}_{2}$ each represents a methyl group; and n represents 1; when $L^{B}_{1}$, $L^{B}_{2}$, and $L^{B}_{3}$ each represents

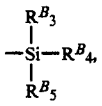

$R^{B}_{3}$, $R^{B}_{4}$, and $R^{B}_{5}$ ( which may be the same or different) each preferably represents a hydrogen atom, a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, chlorobenzyl, methoxybenzyl), a substituted or unsubstituted aromatic group (e.g., phenyl, naphthyl, chlorophenyl, tolyl, methoxyphenyl, methoxycarbonylphenyl, dichlorophenyl), or $-O-R^{B'''}$, wherein $R^{B'''}$ represents a hydrocarbon group, and more specifically, the substituent recited above as examples of $R^{B}_{3}$, $R^{B}_{4}$, and $R^{B}_{5}$; when $L^{B}_{1}$, $L^{B}_{2}$, and $L^{B}_{3}$ each represents

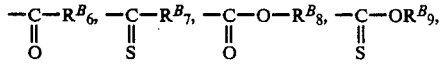

or $-S-R^{B}_{10}$, $R^{B}_{6}$, $R^{B}_{7}$, $R^{B}_{8}$, $R^{B}_{9}$, and $R^{B}_{10}$ each represents a hydrocarbon group, and preferably a substituted or unsubstituted straight chain or branched alkyl group having from 1 to 6 carbon atoms (e.g., methyl, trichloromethyl, trifluoromethyl, methoxymethyl, phenoxymethyl, 2,2,2-trifluoroethyl, ethyl, propyl, hexyl, t-butyl, hexafluoroisopropyl), a substituted or unsubstituted aralkyl group having from 7 to 9 carbon atoms (e.g., benzyl, phenethyl, methylbenzyl, trimethylbenzyl, heptamethylbenzyl, methoxybenzyl), or a substituted or unsubstituted aryl group (e.g., phenyl, tolyl, xylyl, nitrophenyl, cyanophenyl, methanesulfonylphenyl, methoxyphenyl, butoxyphenyl, chlorophenyl, dichlorophenyl, trifluoromethylphenyl); or when $L^{B}_{1}$, $L^{B}_{2}$, and $L^{B}_{3}$ each represents

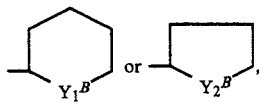

$Y^{B}_{1}$ and $Y^{B}_{2}$ each represents an oxygen atom or a sulfur atom.

The resin containing at least one of the functional groups represented by formulae (X) to (XI) can be prepared by a process comprising protecting the phosphono group of formula (VIII) or (IX) of a polymer with a protective group through high-molecular reaction, or a process comprising polymerizing at least one monomer containing at least one of the protected functional groups [e.g., the functional groups of formula (X) or (XI)] or copolymerizing such a monomer with other copolymerizable monomers.

In either of these processes, introduction of a protective group can be carried out through known synthesis reactions, such as the processes described in references cited, e.g., in J. F. W. Mc. Omie, *Protective Groups in Organic Chemistry,* Ch. 6, Plenum Press (1973), processes analogous to the process for introducing a protective group to a hydroxyl group as described in references cited in Nippon Kagakukai (ed.), *Shin Jikken Kagaku Koza,* Vol. 14, "Yuki Kagobutsu no Gosei to Han-no [V]", 2497, Maruzen K. K. (1978), and processes analogous to the process for introducing a protective group to a thiol group as described in references cited in S. Patai, *The Chemistry of the Triol Group Part* 2, Chs. 13–14, Wiley-Interscience (1974) and T. W.

Greene, *Protective Groups in Organic Synthesis,* Ch. 6, Wiley-Interscience (1981).
Specific but non-limiting examples of the polymer component containing the functional group of formula (X) or (XI) are shown below:
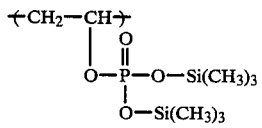
(54)
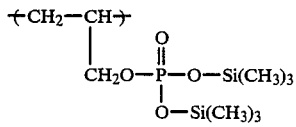
(55)
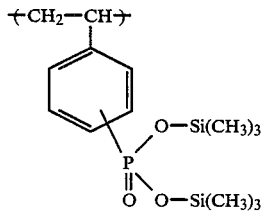
(56)
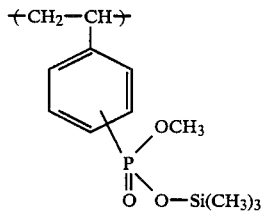
(57)
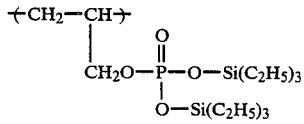
(58)
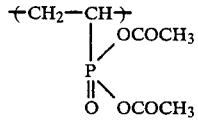
(59)
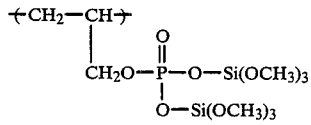
(60)
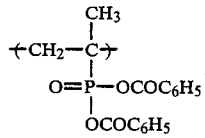
(61)
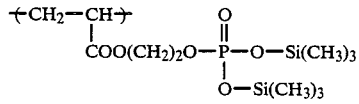
(62)
-continued
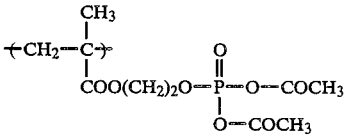
(63)
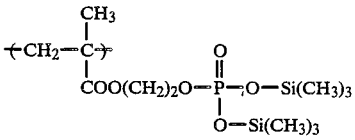
(64)
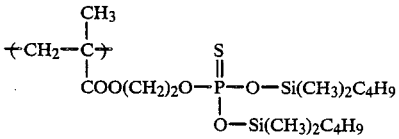
(65)
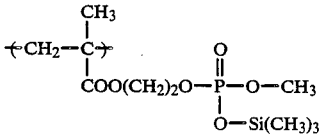
(66)
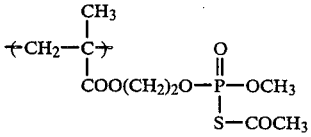
(67)
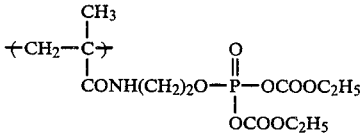
(68)
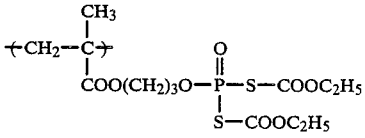
(69)
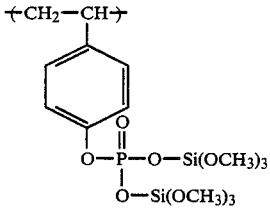
(70)
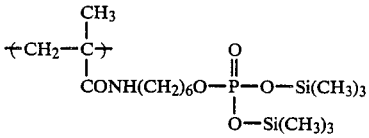
(71)
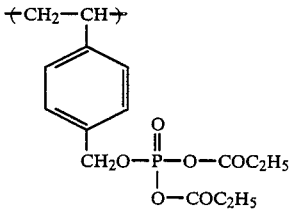
(72)

-continued (73)

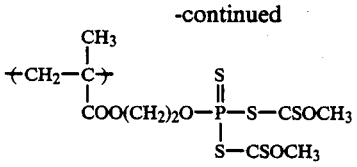

(74)

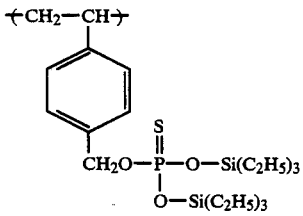

(75)

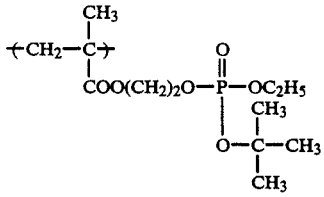

(76)

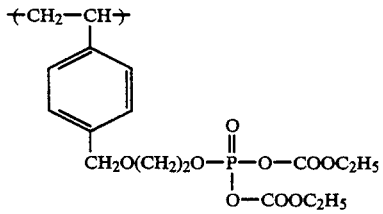

(77)

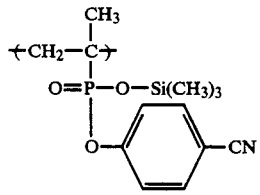

(78)

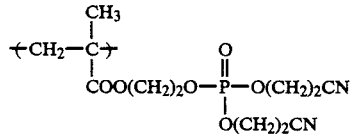

The resin containing at least one functional group capable of forming an amino group, e.g., $—NH_2$ and/or $—NHR^C$ ($R^C$ is defined below), includes a resin containing at least one of functional groups represented by formulae (XII) to (XIV):

(XII)

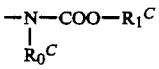

(XIII)

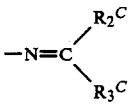

(XIV)

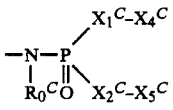

In formulae (XII) and (XIV), $R^C_0$ represents a hydrogen atom, a substituted or unsubstituted alkyl group having from 1 to 12 carbon atoms (e.g., methyl, ethyl, propyl, butyl, hexyl, octyl, decyl, dodecyl, 2-chloroethyl, 2-bromoethyl, 3-chloropropyl, 2-cyanoethyl, 2-methoxyethyl, 2-ethoxyethyl, 2-methoxycarbonylethyl, 3-methoxypropyl, 6-chlorohexyl), an alicyclic group having from 5 to 8 carbon atoms (e.g., cyclopentyl, cyclohexyl), a substituted or unsubstituted aralkyl group having from 7 to 12 carbon atoms (e.g., benzyl, phenethyl, 3-phenylpropyl, 1-phenylpropyl, chlorobenzyl, methoxybenzyl, bromobenzyl, methylbenzyl), a substituted or unsubstituted aryl group having from 6 to 12 carbon atoms (e.g., phenyl, chlorophenyl, dichlorophenyl, tolyl, xylyl, mesityl, chloromethyl, chlorophenyl, methoxyphenyl, ethoxyphenyl, chloromethoxyphenyl), etc.

Of the hydrocarbon groups as represented by $R^C_0$, preferred is a hydrocarbon group having from 1 to 8 carbon atoms.

In formula (XII), $R^C_1$ represents a substituted or unsubstituted aliphatic group having from 2 to 12 carbon atoms, and specifically a group represented by formula (XV):

(XV)

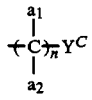

wherein $a_1$ and $a_2$ each represents a hydrogen atom, a halogen atom (e.g., fluorine, chlorine), or a substituted or unsubstituted hydrocarbon group having from 1 to 12 carbon atoms (e.g., methyl, ethyl, propyl, butyl, hexyl, methoxymethyl, ethoxymethyl, 2-methoxyethyl, 2-chloroethyl, 3-bromopropyl, cyclohexyl, benzyl, chlorobenzyl, methoxybenzyl, methylbenzyl, phenethyl, 3-phenylpropyl, phenyl, tolyl, xylyl, mesityl, chlorophenyl, methoxyphenyl, dichlorophenyl, chloromethylphenyl, naphthyl); $Y^C$ represents a hydrogen atom, a halogen atom (e.g., fluorine, chlorine), a cyano group, an alkyl group having from 1 to 4 carbon atoms (e.g., methyl, ethyl, propyl, butyl), a substituted or unsubstituted aromatic group (e.g., phenyl, tolyl, cyanophenyl, 2,6-dimethylphenyl, 2,4,6-trimethylphenyl, heptamethylphenyl, 2,6-dimethoxyphenyl, 2,4,6-trimethoxyphenyl, 2-propylphenyl, 2-butylphenyl, 2-chloro-6-methylphenyl, furanyl),or $—SO_2—R^C_6$, wherein $R^C_6$ meaning as the hydrocarbon groups as represented by $Y^C$, and n represents 1 or 2.

When $Y^C$ is a hydrogen atom or an alkyl group, $a_1$ and $a_2$ on the carbon atom adjacent to the oxygen atom of the urethane linkage each preferably represents a substituent other than a hydrogen atom. When $Y^C$ neither a hydrogen atom nor an alkyl group, $a_1$ and $a_2$ may be any of the above-recited substituents. In other words, it is preferable that

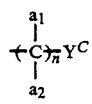

forms a group containing at least one electron attracting group, or the carbon atoms adjacent to the oxygen atom of the urethane linkage forms a bulky group.

More specifically, $R^{C}_{1}$ represetns an alicyclic group (such as a monocyclic hydrocarbon group (e.g., cyclopropyl, cyclobutyl, cyclopentyl, cyclohexyl, 1-methylcyclohexyl, 1-methylcyclobutyl) and a cross-linked cyclic hydrocarbon group (e.g., bicyclooctane, bicyclooctene, bicyclononane, tricycloheptane)).

In formula (XIII), $R^{C}_{2}$ and $R^{C}_{3}$, (which may be the same or different) each represents a hydrocarbon group having from 1 to 12 carbon atoms, and specifically includes the aliphatic groups and aromatic groups as enumerated for $Y^{C}$ in formula (XII).

In formula (XIV), $X^{C}_{1}$ and $X^{C}_{2}$ (which may be the same or different) each represents an oxygen atom or a sulfur atom; and $X^{C}_{4}$ and $X^{C_5}$ (which may be the same or different) each represents a hydrocarbon group having from 1 to 8 carbon atoms, and specifically the aliphatic or aromatic groups as enumerated for $Y^{C}$ in formula (XII).

Specific but non-limiting examples of the functional group represented by formulae (XII) to (XIV) are shown below:

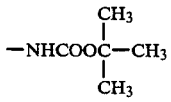
(79)

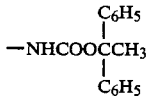
(80)

$-NHCOOCH_2CF_3$ (81)

$-NHCOOCH_2CCl_3$ (82)

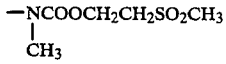
(83)

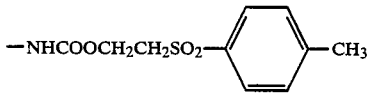
(84)

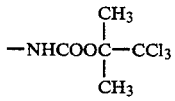
(85)

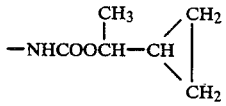
(86)

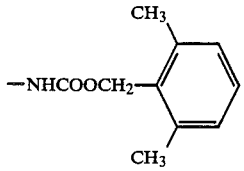
(87)

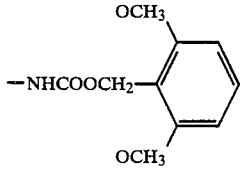
(88)

-continued

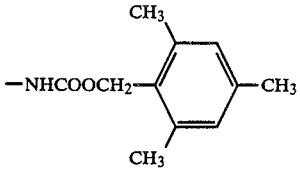
(89)

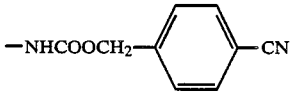
(90)

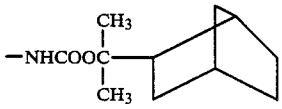
(91)

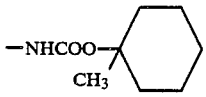
(92)

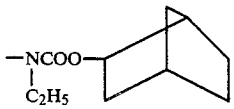
(93)

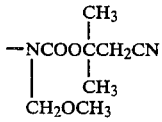
(94)

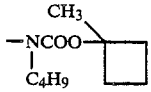
(95)

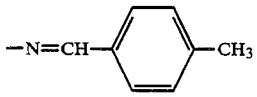
(96)

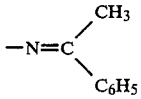
(97)

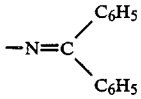
(98)

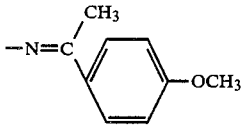
(99)

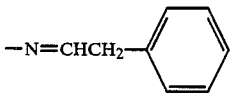
(100)

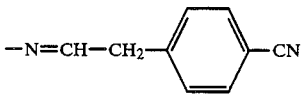
(101)

-continued

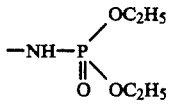

(102)

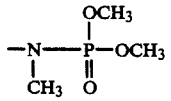

(103)

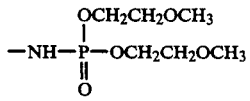

(104)

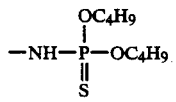

(105)

The resin containing at least one functional group capable of forming an amino group (e.g., $—NH_2$ and/or $—NHR^C$), such as the groups represented by formulae (XII) to (XIV), can be prepared by known processes as described in references cited in Nippon Kagakukai(ed.), *Shin Jikken Kagaku Koza,* Vol. 14, "Yuki Kagobutsu no Gosei to Han-no [V]", 2555, Maruzen K. K. and J. F. W. McOmie, *Protective Groups in Organic Chemistry,* Ch. 2, Plenum Press (1973), *Protective Groups in Organic Synthesis,* Ch. 7, John Wiley & Sons (1981).

Of these processes, preferred are those comprising polymerizing a monomer containing any of the functional groups of formulae (XII) to (XIV) is preferred because the functional group in the polymer can be controlled arbitrarily and the resulting polymer is free from contamination by impurities. In some detail, a compound containing a polymerizable double bond and a primary or secondary amino group is reacted to convert its amino group to the functional group of formula (XII) to (XIV) according to the processes above cited, followed by polymerization.

The resin containing at least one functional group capable of forming at least one sulfo group on decomposition includes a resin containing a functional group represented by formula (XVI) or (XVII):

$$—SO_2—O—R^D{}_1 \quad \text{(XVI)}$$

$$—SO_2—S—R^D{}_2 \quad \text{(XVII)}$$

In formula (XVI), $R^D{}_1$ represents

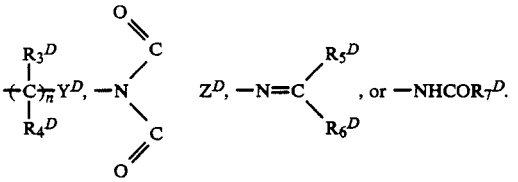

In formula (XVII), $R^D{}_2$ represents a substituted or unsubstituted aliphatic group having from 1 to 18 carbon atoms or a substituted or unsubstituted aryl group having from 6 to 22 carbon atoms.

The function group represented by formulae (XVI) and (XVII) forms a sulfo group on decomposition.

In the case where $R^D{}_1$ is

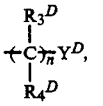

$R^D{}_3$ and $R^D{}_4$ (which may be the same or different) each represents a hydrogen atom, a halogen atom (e.g., fluorine, chlorine, bromine), an alkyl group having from 1 to 6 carbon atoms (e.g., methyl, ethyl, propyl, butyl, pentyl, hexyl), or an aryl group (e.g., phenyl); $Y^D$ represents a substrituted or unsubstituted alkyl group having from 1 to 18 carbon atoms (e.g., methyl, ethyl, propyl, butyl, pentyl, hexyl, octyl, decyl, dodecyl, hexadecyl, trifluoromethyl, methanesulfonylmethyl, cyanomethyl, 2-methoxyethyl, ethoxymethyl, chloromethyl, dichloromethyl, trichloromethyl, 2-methoxycarbonylethyl, 2-propoxycarbonylethyl, methylthiomethyl, ethylthiomethyl), a substituted or unsubstituted alkenyl group having from 2 to 18 carbon atoms (e.g., vinyl, allyl), a substituted or unsubstituted aryl group having from 6 to 12 carbon atoms (e.g., phenyl, naphthyl, nitrophenyl, dinitrophenyl, cyanophenyl, trifluoromethylphenyl, methoxycarbonylphenyl, butoxycarbonylphenyl, methanesulfonylphenyl, benzenesulfonylphenyl, tolyl, xylyl, acetoxyphenyl, nitronaphthyl), or

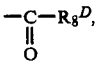

wherein $R^D{}_8$ represents an aliphatic group or an aromatic group, and specifically includes the substituents recited for $Y^D$; and n represents 0, 1 or 2.

Of these functional groups, preferred are those wherein

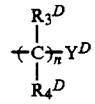

contains at least one electron accepting group. More specifically, such groups includes those in which n is 0, $Y^D$ contains no electron accepting group, and

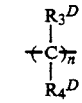

contains at least one halogen atom; those in which n is 0, 1, or 2, and $Y^D$ contains at least one electron accepting group; and those in which n is 1 or 2, and $Y^D$ is

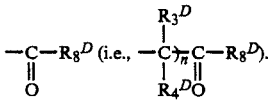

The electron accepting group herein referred to means a substituent whose Hammett's $\sigma$ value is positive and includes, for example, a halogen atom, $-COO-$, $-\underset{\underset{O}{\|}}{C}-$, $-SO_2-$, $-CN$, and $-NO_2$.

Also preferred are those wherein the carbon atom adjacent to the oxygen atom has at least two hydrocarbon groups and those which n is 0 or 1 and $Y^D$ is an aryl group having a substituent on the 2- and 6-positions thereof.

In the case where $R^D{}_1$ is

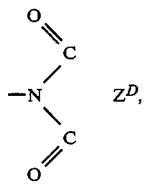

$Z^D$, $Z^D$ represents an organic residual group forming a cyclic imido group, and preferably an organic residual group represented by formula (XVIII):

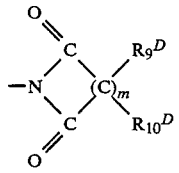

(XVIII)

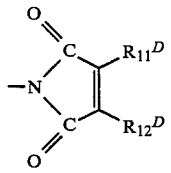

(XIX)

In formula (XVIII), $R^D{}_9$ and $R^D{}_{10}$ (which may be the same or different) each represents a hydrogen atom, a halogen atom (e.g., chlorine, bromine), a substituted or unsubstituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), a substituted or unsubstituted aralkyl group having from 7 to 12 carbon atoms (e.g., benzyl, phenethyl, 3-phenylpropyl, methylbenzyl, dimethylbenzyl, methoxybenzyl, chlorobenzyl, bromobenzyl), or a substituted or unsubstituted alkenyl group having from 3 to 18 carbon atoms (e.g., allyl, 3-methyl-2-propenyl); and m represents 2 or 3.

In formula (XIX), $R^D{}_{11}$ and $R^D{}_{12}$ represent the same groups as $R^D{}_9$ and $R^D{}_{10}$, or $R^D{}_{11}$ and $R^D{}_{12}$ represent organic groups which together form a 5- or 6-membered alicyclic group (e.g., a cyclopentane or cyclohexane ring) or a benzene ring.

In the case where $R^D{}_1$ is

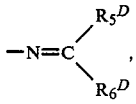

$R^D{}_5$ and $R^D{}_6$ each represents a hydrogen atom, an aliphatic group (specifically including the aliphatic groups as represented by $R^D{}_3$ or $R^D{}_4$), or an aryl group (specifically including the aryl group as represented by $R^D{}_3$ or $R^D{}_4$), provided that $R^D{}_5$ and $R^D{}_6$ do not both represent a hydrogen atom.

In the case where $R^D{}_1$ is $-NHCOR^D{}_7$, $R^D{}_7$ represents an aliphatic group or an aryl group (specifically including the aliphatic group or aryl group as represented by $R^D{}_3$ or $R^D{}_4$).

In formula (XVII), $R^D{}_2$ represents a substituted or unsubstituted aliphatic group having from 1 to 18 carbon atoms or a substituted or unsubstituted aryl group having from 6 to 22 carbon atoms. More specifically, $R^D{}_2$ represents the same aliphatic or aryl group as recited for $Y^D$ in formula (XVI).

The resin containing at least one of the functional groups represented by formulae (XVI) and (XVII) can be obtained by a process comprising converting a sulfo group of a polymer to the functional group of formula (XVI) or (XVII) through high-molecular reaction, or a process comprising polymerizing at least one monomer containing one or more of the functional groups of formulae (XVI) and (XVII) or copolymerizing such a monomer with other copolymerizable monomers.

Conversion of a sulfo group into the functional group by high-molecular reaction can be carried out in the same manner as a process for synthesizing the above-described monomer.

Specific but non-limiting examples of the sulfo-forming functional group represented by formula (XVI) or (XVII) are shown below.

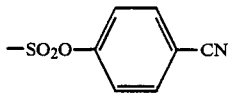

(106)

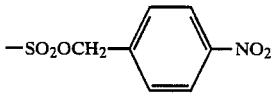

(107)

$-SO_2OCH_2CF_3$ (108)

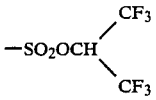

(109)

$-SO_2OCH_2(CHF)_2CH_2F$ (110)

$-SO_2OCH_2CCl_3$ (111)

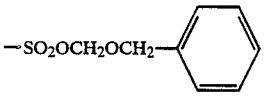

(112)

$-SO_2O(CH_2)_2SO_2C_4H_9$ (113)

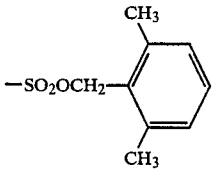

(114)

-continued
(115)
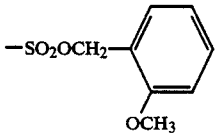
(116)
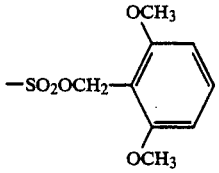
(117)
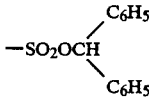
(118)
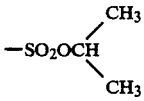
(119)
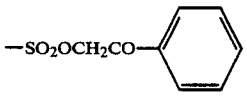
(120)
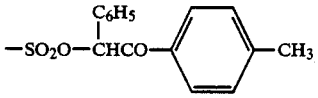
(121)
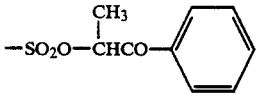
(122)
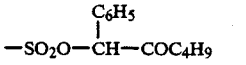
(123) $-SO_2O(CH_2)_2SO_2C_2H_5$
(124) $-SO_2SC_4H_9$
(125) $-SO_2SC_6H_{13}$
(126) $-SO_2S(CH_2)_2OC_2H_5$
(127)
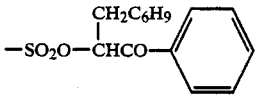
(128) $-SO_2OCH_2CHFCH_2F$
(129)
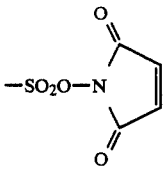
(130)
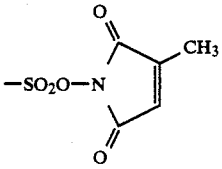
-continued
(131)
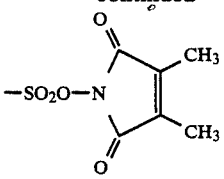
(132)
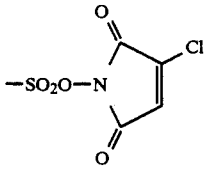
(133)
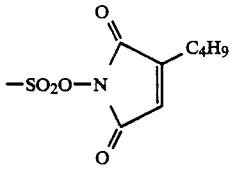
(134)
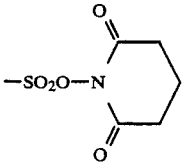
(135)
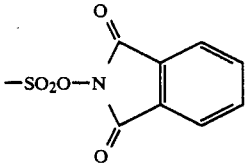
(136)
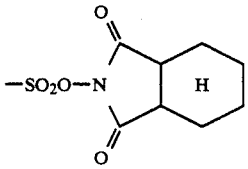
(137)
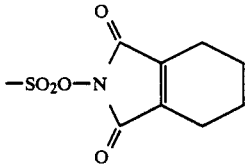
(138)
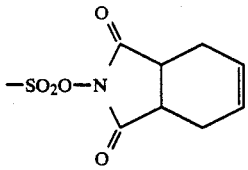
The copolymer component containing any of the functional groups represented by formulae (I) to (X) to (XIV), (XVI), and (XVII) which can be used in the aforesaid polymerization process specifically but unlimitedly includes those represented by formula (A):

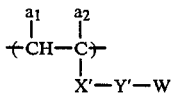

(A)

wherein X' represents —O—, —CO—, —COO—, —OCO—,

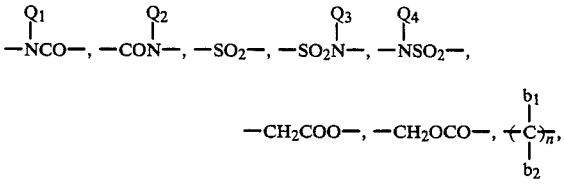

an aromtic group, or a heterocyclic group, wherein $Q_1$, $Q_2$, $Q_3$, and $Q_4$ each represents a hydrogen atom, a hydrocarbon group, or the group Y'—W) in formula (A); $b_1$ and $b_2$ (which may be the same or different) each represents a hydrogen atom, a hydrocarbon group, or the group Y'—W) in formula (A); and n represents 0 or an integer of from 1 to 18; Y' represents a carbon-carbon bond which may contain a hetero atom (e.g., oxygen, sulfur, or nitrogen) for linking X' and W; W represents the functional group represented by formula (I) to (VII), (X) to (XIV), (XVI), or (XVII); and $a_1$ and $a_2$ (which may be the same or different) each represents a hydrogen atom, a halogen atom (e.g., chlorine, bromine), a cyano group, a hydrocarbon group [such as a substituted or unsubstituted alkyl group having from 1 to 12 carbon atoms (e.g., methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl), an aralkyl group (e.g., benzyl, phenethyl), and an aryl group (e.g., phenyl, tolyl, xylyl, chlorophenyl), or an alkyl group having from 1 to 18 carbon atoms, an alkenyl group, an aralkyl group, an alicyclic group or an aromatic group each of which may be substituted with a substituent containing —W in formula (A)], or —X'—Y' represents a chemical bond directly connecting

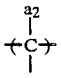

and —W.

In formula (A), the linking group as represented by Y' is composed of one or more of divalent groups, e.g.,

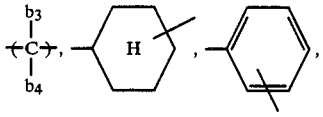

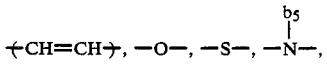

—COO—, —CONH—, —$SO_2$—, —$SO_2$NH—, —NHCOO—, —NHCONH—, etc., wherein $b_3$, $b_4$, and $b_5$ have the same meaning as $b_1$ and $b_2$.

When the resin (A) containing a functional group capable of forming a hydrophilic group such as a thiol group is a copolymer, the proportion of the polymer component containing the hydrophilic group-forming functional group in the copolymer is preferably from 1 to 95% by weight, and more preferably from 5 to 60% by weight. The resin (A) preferably has a molecular weight ranging from $1\times10^3$ to $1\times10^6$, and more preferably from $5\times10^3$ to $5\times10^5$.

In order to enhance crosslinking effects between the resin (A) and the resin (B) and/or crosslinking agent (C), the resin (A) can contain a copolymer component containing a functional group which undergoes crosslinking reaction with the resin (B) and/or cross-linking agent (C) upon heating or irradiation of light. Such a functional group includes a group having at least one dissociative hydrogen atom, e.g., —OH, —SH, —NHR, wherein R represents an alkyl group having up to 8 carbon atoms (e.g., methyl, ethyl, propyl, butyl, hexyl) or an aryl group (e.g., phenyl, tolyl, methoxyphenyl, butylphenyl); an epoxy group, a thioepoxy group, etc. The proportion of the copolymer component containing the above-described functional group in the resin (A) preferably ranges from 1 to 20% by weight, and more preferably from 3 to 10% by weight.

Monomers providing such a copolymer component include vinyl compounds containing the above-recited crosslinkable functional group which are copolymerizable with the hydrophilic group-forming functional group-containing polymer component in the resin (A), for example, the polymer component of formula (A).

These vinyl compounds are described, e.g., in High Molecular Society (ed.), *Kobunshi Data Handbook (Kiso-hen),* Baihukan (1986). Specific examples of the vinyl compounds include acrylic acid, α- and/or β-substituted acrylic acids (e.g., α-acetoxyacrylic acid, α-acetoxymethylacrylic acid, α-(2-aminom)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids having the aforesaid functional group in the substitutent thereof. More specific examples are compounds corresponding to the formula (A) containing the aforesaid crosslinkable functional group in the substituents thereof.

If desired, in addition to the monomer component having the functional group of formulae (I) to (VII), (X) to (XIV), (XVI) and/or (XVII) and the above-described optional monomer component containing the crosslinkable functional group, the resin (A) may further contain other copolymer components. Examples of such copolymer components include α-olefins, alkanoic acid vinyl or allyl esters, acrylonitrile, methacrylonitrile, vinyl ethers, acrylamides, methacrylamides, styrenes, heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, vinyloxazine). From the stand-point of film strength, vinyl acetate, allyl acetate, acrylonitrile, methacrylonitrile, and styrenes are particularly preferred.

The above-described resin (A) can be used either individually or in combination of two or more thereof.

The resin (B) for use in this invention is a known curable resin which undergoes crosslinking reaction by heat and/or light, and preferably a resin capable of crosslinking with the functional group in the resin (A).

The heat-curable resin is described, e.g., in T. Endo, *Netsukokasei Kobunshi no Seimitsuka,* C. M. C. (1986), Y. Harasaki, *Saishin Binder Gijutsu Binran,* Ch. II-1, Sogo Gijutsu Center (1985), T. Ohtsu, *Akuriru Jushi no Gosei Sekkei to Shin-yoto Kaihatsu,* Tyubu Keiei Kaihatsu Center Shuppan-bu (1985), and E. Ohmori, *Kinosei Akuriru-kei Jushi,* Techno System (1985). Examples of the heat-curable resin include polyester resins, modified or unmodified epoxy resins, polycarbonate resins, vinyl alkanoate resins, modified polyamide resins, phenolic resins, modified alkyd resins, melamine resins, acrylic resins, and isocyanate resins.

The photo-curable resin is described, e.g., in H. Inui and G. Nagamatsu, *Kankosei Kobunshi,* Kodansya (1977), T. Tsunoda, *Shin-kankosei Jushi,* Insatsu Gakkai Shuppan-bu (1981), G. E. Green and B. P. Stark, *J. Mcro. Sci. Reas. Macro Chem.,* C 21(2), 187–273 (1981–1982), and C. G. Rattey, *Photopolymerization of Surface Coatings,* A. Wiley Interscience Publ. (1982).

In more detail, the resin (B) includes a polymer containing a functional group capable of crosslinking by heating or irradiation of light. Implicit in such a crosslinkable functional group are those type which undergo chemical bonding with different kinds of functional groups and self-crosslinkable functional groups. For example, the functional groups of the former type are selected from each of Group I and Group II tabulated below.

| Group I | Group II |
|---|---|
| functional groups having a dissociative hydrogen atom: | functional groups capable of chemically bonding to the group of Group I: |
| —OH, —SH, —$NHR_2$ (wherein $R_2$ is the same as the hydrocarbon group as for $R_1^A$( | 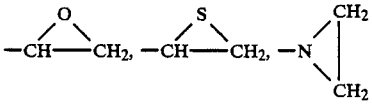 |
| —COOH —$PO_3H_2$ | —N=C=O, —N=C=S, cyclic dicarboxylic acid anhydride groups |

The self-crosslinkable functional groups include —$CONHCH_2OR_3$, wherein $R_3$ is a hydrogen atom, an alkyl group having from 1 to 6 carbon atoms (e.g., methyl, ethyl, propyl, butyl, hexyl), and a group having a polymerizable double bond represented by formula (B):

$$-X''\text{-}(CH_2)_r\text{-}\overset{x_1}{\overset{|}{C}}=\overset{x_2}{\overset{|}{C}}H \qquad \text{(B)}$$

wherein X'' represents —COO—, —OCO—, —CO—, —$SO_2$—, —CONH—, —$SO_2NH$—, —O—, —S—, an aromatic group, or a heterocyclic group; $x_1$ and $x_2$, which may be the same or different, each represents a hydrogen atom or a substituted or unsubstituted hydrocarbon group (e.g., methyl, ethyl, propyl, butyl, hexyl, carboxymethyl, methoxycarbonylmethyl, ethoxycarbonylmethyl, butoxycarbonylmethyl, 2-chloroethyl, 2-methoxyethyl, ethoxymethyl, benzyl, phenethyl, 3-phenylpropyl, chlorobenzyl, bromobenzyl, methylbenzyl, methoxybenzyl, phenyl, tolyl, xylyl, methoxyphenyl, chlorophenyl, bromophenyl); and r represents 0 or 1.

Monomers providing the copolymer component containing these crosslinkable functional groups include vinyl compounds containing such functional groups, and more specifically the compounds described as for the resin (A). Monomers providing other copolymer components which are copolymerized with the crosslinkable functional group-containing copolymer component include those enumerated as for the resin (A).

It is preferable that the resin (B) contains from 1 to 80% by weight of the crosslinkable functional group-containing copolymer component. The resin (B) preferably has a weight average molecular weight of from $1\times10^3$ to $5\times10^5$, and more preferably from $5\times10^3$ to $5\times10^5$.

In cases wherein the resin binder according to the present invention comprises the resin (A) and the resin (B), crosslinking reaction takes place between the resin (A) and the resin (B) and/or self-crosslinking reaction takes place among the molecules of the resin (B). In these cases, the ratio of the resin (A) to resin (B) usually ranges from 5/95 to 80/20 by weight, and preferably from 15/85 to 60/40 by weight.

The crosslinking agent which can be used in combination with the resin (A) is selected from compounds commonly employed as crosslinking agent. Examples of usable crosslinking agents are described, e.g., in S. Yamashita and T. Kaneko (ed.), *Kakyozai Handbook,* Taiseisha (1981) and Kobunshi Gakkai (ed.), *Kobunshi Data Handbood (Kiso-hen),* Baihukan (1986). Specific examples are organosilane compounds such as silane coupling agents (e.g., vinyltrimethoxysilane, vinyltributoxysilane, γ-glycidoxypropyltrimethoxysilane, γ-mercaptopropyltriethoxysilane, γ-aminopropyltriethoxysilane), polyisocyanate compounds (e.g., toluylene diisocyanate, o-toluylene diisocyanate, diphenylmethane diisocyanate, triphenylmethane triisocyanate, polymethylene polyphenyl isocyanate, hexamethylene diisocyanate, isophorone diisocyanate, high-molecular polyisocyanates), polyol compounds (e.g., 1,4-butanediol, polyoxypropylene glycol, polyoxyalkylene glycols, 1,1,1-trimethylolpropane), polyamine compounds (e.g., ethylenediamine, γ-hydroxypropylated ethylenediamine, phenylenediamine, hexamethylenediamine, N-aminoethylpiperazine, modified aliphatic polyamines), polyepoxycontaining compounds and epoxy resins [e.g., the compounds described in H. Kakiuchi (ed.), *Shin-epoxy Jushi,* Shokodo (1985), and K. Hashimoto (ed.), *Epoxy Jushi,* Nikkan Kogyo Shinbunsha (1969)], melamine resins [e.g., the compounds described in I. Miwa and H. Matsunaka (ed.), *Urea Melamine Jushi,* Nikkan Kogyo Shinbunsha (1969)], and polyfunctional monomer compounds having at least two polymerizable double bonds [e.g., the compounds described in S. Ohgawara, T. Saegusa, and T. Higashimura (ed.), *Oligomer,* Kodansha (1976), and E. Ohmori, *Kinosei Akuriru-kei Jushi,* Techno System (1985)]. Specific examples of these crosslinking agents are divinylbenzene, divinylglutaconic acid diesters, vinyl methacrylate, allyl methacrylate, ethylene glycol dimethacrylate, polyethylene glycol diacrylate, neopentylglycol diacrylate, 1,6-hexanediol diacrylate, trimethylolpropane triacrylate, pentaerythritol polyacrylate, bisphenol A diglycidiyl ether diacrylate, oligoester acrylates; and the corresponding methacrylates.

The content of the crosslinking agent in the resin binder preferably ranges from 0.1 to 30% by weight, and more preferably from 0.5 to 20% by weight.

The resin binder according to the present invention contain either one or both of the resin (B) and the crosslinking agent. If desired, the resin binder may further contain a reaction accelerator. For example, in the case where the resin binder contains the resin (B) containing a heat-curable functional group, an acid, e.g., an organic acid (e.g., acetic acid, propionic acid, butyric acid) may be added as a reaction accelerator.

In the case where the resin binder contains the resin (B) containing a photo-crosslinkable functional group, the resin binder may further contain a sensitizer, a photopolymerizable monomer, and the like. Specific examples of these components are described in the references cited above with respect to photosensitive resins.

A photosensitive coating composition comprising zinc oxide and the resin binder of the invention is coated on a support and then subjected to crosslinking reaction by heating or irradiation of light. When the resin binder is heat-curable, the crosslinking is preferably carried out by drying the photosensitive coating at a high temperature and/or for a long time, or further heating the dried photosensitive coating, e.g., at 60° to 120° C. for 5 to 120 minutes. When the resin binder contains the photo-crosslinkable resin (B), the crosslinking can be effected by irradiating an electron ray, an X-ray, a ultraviolet ray, or plasma beam. Such photo-crosslinking may be conducted either during drying or before or after the drying. The photo-crosslinking reaction can be accelerated by heating under the above-described drying conditions.

The crosslinking reaction proceeds under mild conditions when the resin binder contains both the resin (B) and the crosslinking agent, or when the above-described reaction accelerator is used in combination, or when the resin (A) contains the above-described crosslinkable functional group.

It is essential that the crosslinking should take place at least between resins of the present invention, but it may take place among other resins.

It is preferable that the resin binder of the present invention becomes sparingly soluble or insoluble in an acidic or alkaline aqueous solution when the hydrophilic group-forming functional group decomposes to form a hydrophilic group, e.g., a thiol group.

In combination with the resin binder of the present invention, conventionally known resins may be used. Usable known resins include the above-described silicone resins, alkyd resins, vinyl acetate resins, polyester resins, styrene-butadiene resins, and acrylic resins. Specific examples of these resins are described in T. Kurita and J. Ishiwatari, *Kobunshi,* Vol. 17, 278 (1968) and H. Miyamoto and H. Takei, *Imaging,* No. 8, 9 (1973).

The photoconductive layer of the lithographic printing plate precursor according to the present invention usually comprises from 10 to 60 parts by weight, and preferably from 15 to 40 parts by weight, of the resin binder per 100 parts by weight of photoconductive zinc oxide.

In case when a conventional resin binder containing the hydrophilic group from the first is employed in the production of lithographic printing plate precursors, a dispersion of zince oxide in this resin has an increased viscosity so that the photoconductive layer formed by coating such a dispersion has seriously deteriorated smoothness or insufficient film strength and is also unsatisfactory in electrophotographic characteristics. Even if a printing plate precursor having sufficient smoothness might be obtained, stains tend to be formed during printing. Hydrophilic groups contained in the conventional resin may be adjusted so as to produce a printing plate precursor which can reproduce a satisfactory image and provide a satisfactory print, but the quality of the reproduced image of the precursor is subject to deterioration due to changes of environmental conditions. That is, if the environmental condition during electrophotographic image formation processing is changed to a low temperature and low humidity condition or a high temperature and high humidity condition (particularly, to a high temperature and high humidity condition), the reproduced image suffers from background fog, reduction in density of image areas, or disappearance of fine lines or letters.

These unfavorable phenomena accompanied by the conventional lithographic printing plate precursors are presumably attributed to the following reasons. Since the interaction between the hydrophilic groups in the resin binder and surfaces of photoconductive zinc oxide particles is strong, the resin adsorption on the surfaces of zinc oxide particles increases. As a result, compatibility of the photoconductive layer with an oil-desensitizing solution or dampening water is impaired. Otherwise, even when the hydrophilic groups in the resin binder may be adjusted adequately with respect to zinc oxide particles, the hydrophilic atmosphere on the boundaries between the hydrophilic groups in the resin and the zinc oxide particles greatly changes upon exposure to a low-temperature and low-humidity condition or a high-temperature and high-humidity condition so that electrophotographic characteristics, such as surface potential or dark decay after charging, are deteriorated.

The resin binder according to the present invention and the known resins may be used at an arbitrary mixing ratio, but it is derirable that the proportion of the hydrophilic group-forming functional group-containing resin (A) in the total resin should be in the range of from about 1 to 90% by weight, and particularly when the binder contains the resin (8), from about 1 to 80% by weight.

If the content of the resin (A) in the total resin is less than the lower limit recited above, the resulting lithographic printing plate shows insufficient hydrophilic properties after oil-desensitization with an oil-desensitizing solution or dampening water, causing stains on printing. On the other hand, if it exceeds the upper limit recited above, the lithographic printing plate precursor has poor image-forming properties.

The resin (A) according to the present invention which contains at least one functional group capable of forming a hydrophilic group is hydrolyzed or hydrogenolyzed upon contact with an oil-desensitizing solution or dampening water used on printing to thereby form a hydrophilic group. Therefore, when the resin (A) is used as a binder for a lithographic printing plate precursor, hydrophilic properties of non-image areas attained by processing with an oil-desensitizing solution can be enhanced by the thus formed hydrophilic groups. As a result, a marked contrast can be afforded between lipophilic properties of image areas and hydrophilic properties of non-image areas to prevent adhesion of a printing ink onto the non-image areas during printing. It has thus been realized to provide a lithographic printing plate capable of producing a larger number of prints having a clear image free from background stains as compared with lithographic printing plates prepared by using conventional resin binders.

Further, since the resin binder of the invention contains the crosslinking agent (C) and/or resin (B) which undergoes crosslinking with the resin (A), crosslinking reaction takes place during the formation of a photoconductive layer or heating and/or light irradiation before etching to form a crosslinked structure between high-molecular weight polymers.

The resin containing a hydrophilic group formed on decomposition is rendered hydrophilic by etching treatment or treating with a dampening water during printing, and, with a high content of such a resin, the resin binder becomes water-soluble. However, since the resin binder of the present invention has a crosslinked structure formed by crosslinking with the resin (B) and/or the crosslinking agent, the binder becomes sparingly water soluble or water-insoluble while retaining hydrophilic properties. Therefore, the effects of the hydrophilic group formed in the resin to impart hydrophilic properties to the non-image areas are further ensured by such a crosslinked structure thereby improving printing durability of the printing plate.

Describing these effects more specifically, the present invention makes it possible to maintain the effects of improving hydrophilic properties even if the proportion of the functional group-containing resin in the total resin binder is decreased, or to produce a large number of clear prints free from background stains even if printing conditions are made more strict through an increase of a printing machine in size or a variation of printing pressure.

If desired, the photoconductive layer may further contain various dyes as spectral sensitizers, such as carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metallized phthalocyanine dyes, as described, e.g., in H. Miyamoto and H. Takei, *Imaging,* No. 8, 12 (1973), C. J. Young, et al., *RCA Review,* Vol. 15, 469 (1954), K. Kiyota, et al., *Denki Tsushin Gakkai Ronbunshi J* 63-*C,* No. 2, 97 (1980), Y. Harasaki, *Kogyo Kagaku Zasshi,* Vol. 66, 78 and 188 (1963), and T. Tani, *Nippon Shashin Gakkaishi,* Vol. 35, 208 (1972).

More specifically, the carbonium dyes, triphenylmethane dyes, xanthene dyes, and phthalein dyes are described in JP-B-51-452, JP-A-50-90334, 50-114227, 53-39130, and 53-82353, U.S. Pat. Nos. 3,052,540 and 4,054,450, and JP-A-57-16456. The polymethine dyes, e.g., oxonol dyes, merocyanine dyes, cyanine dyes, and rhodacyanine dyes are described in F. M. Harmmer, *The Cyanine Dyes and Related Compounds.* Specific examples of these polymethine dyes are described in U.S. Pat. Nos. 3,047,384, 3,110,591, 3,121,008, 3,125,447, 3,128,179, 3,132,942, and 3,622,317, British Patent Nos. 1,226,892, 1,309,274, and 1,405,898, and JP-B-48-7814 and 55-18892. Polymethine dyes which spectrally sensitize the near infrared to infrared regions of wavelengths longer than 700 nm are described in JP-A47-840 and 47-44180, JP-8-51-41061, JP-A-49-5034, 49-45122, 57-46245, 56-35141, 57-157254, 61-26044, and 61-27551, U.S. Pat. Nos. 3,619,154 and 4,175,956, and *Research Disclosure,* 216, 117–118 (1982).

The photoconductive layer of the present invention is excellent in that their performance properties are not liable to variation due to sensitizing dyes used.

The photoconductive layer may furthermore contain various additives known for electrophotographic photosensitive layer, such as chemical sensitizers. Examples of the additives include electron accepting compounds (e.g., halogen, benzoquinone, chloranil, acid anhydrides, organic carboxylic acids) as described in *Imaging,* No. 8, 12 (1973), and polyarylalkane compounds, hindered phenol compounds, and p-phenylenediamine compounds as described in H. Kokado, et al., *Saikin no Kododen Zairyo to Kankotai no Kaihatsu Jitsuyoka,* Chs. 4–6, Nippon Kagaku Joho, Shuppan-bu (1986). The amount of these additives is not particularly limited, but usually ranges from 0.0001 to 2.0 parts by weight per 100 parts by weight of a photoconductive substance.

The photoconductive layer can be provided on any known support usually to a thickness of from 1 to 100 μm, and preferably from 10 to 50 μm. In general, the support for an electrophotographic photosensitive layer is preferably electrically conductive. Any of conventionally employed conductive supports may be utilized in this invention. Examples of usable conductive supports include a base material (e.g., a metal sheet, paper, a plastic sheet) having been rendered electrically conductive by, for example, impregnating with a low resistant substance; a base material with its back side (i.e., the side opposite to the photosensitive layer) being rendered coductive and further coated thereon at least one layer for preventing curling, etc.; the aforesaid supports having further provided thereon a water-resistant adhesive layer; the aforesaid supports having further provided thereon at least one precoat layer; and paper laminated with a plastic film on which aluminum, etc. is deposited.

Specific examples of the conductive supports and materials for imparting conductivity are described in S. Sakamoto, *Denshishashin,* Vol. 14, No. 1, 2–11 (1975), H. Moriga, *Nyumon Tokushushi no Kagaku,* Kobunshi Kankokai (1975), and M. F. Hoover, *J. Macromol. Sci. Chem.,* A-4(6), 1327–1417 (1970).

The present invention is now illustrated in greater detail by way of examples, but it should be understood that the present invention is not deemed to be limited thereto. In these examples, all the ratios are by weight unless otherwise specified.

EXAMPLE 1

A mixed solution consisting of 48 g of benzyl methacrylate, 12 g of 2-hydroxyethyl methacrylate, 40 g of a monomer compound (i) of formula:

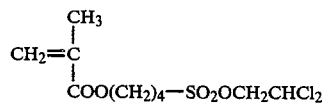

and 300 g of toluene was heated to 75° C. under a nitrogen stream, and 1.0 g of azobisisobutyronitrile (AIBN) was added thereto, followed by allowing to react for 8 hours. The resulting copolymer was designated as (A-1). The copolymer (A-1) had a weight average molecular weight (Mw) of 40,000.

A mixture of 12 g (as solid content) of (A-1), 28 g of a buthyl methacrylate/acrylic acid copolymer (99/1; Mw=45,000), 200 g of zinc oxide, 0.05 g of Rose Bengale, 0.01 g of phthalic anhydride and 300 g of toluene was dispersed in a ball mill for 1.5 hours. To the dispersion was added 6 g of hexamethylene diisocyanate, and the mixture was further dispersed in a ball mill for 10 minutes to prepare a photosensitive coating composition. The composition was coated on paper having been rendered electrically conductive to a dry coverage of 25 g/m$^2$ with a wire bar, followed by drying at 100° C. for 90 minutes. The photosensitive layer was then allowed to stand in a dark place at 20° C. and 65% RH for 24 hours to produce an electrophotographic lithographic printing plate precursor.

COMPARATIVE EXAMPLE 1

A mixed solution consisting of 60 g of benzyl methacrylate, 40 g of the monomer compound (i) as used in Example 1, and 200 g of toluene was heated to 70° C. under a nitrogen stream, and 1.0 g of AIBN was added thereto. The mixture was allowed to react for 8 hours. The resulting copolymer had an Mw of 45,000.

A mixture of 12 g (as solid content) of the resulting copolymer, 28 g of a butyl methacrylate/acrylic acid copolymer (99/1; Mw=45,000), 200 g of zinc oxide, 0.05 g of Rose Bengale, 0.01 g of phthalic anhydride, and 300 g of toluene was dispersed in a ball mill for 2 hours to prepare a photosensitive coating composition. The composition was coated on paper having been rendered conductive to a dry coverage of 25 g/m$^2$ with a wire bar, followed by drying at 110° C. for 1 minute. The photosensitive layer was then allowed to stand in a dark place at 20° C. and 65% RH for 24 hours to produce an electrophotographic lithographic printing plate precursor.

COMPARATIVE EXAMPLE 2

A mixed solution consisting of 85 g of benzyl methacrylate, 15 g of 2-hydroxyethyl methacrylate, and 200 g of toluene was subjected to polymerization reaction in the same manner as in Comparative Example 1. The resulting copolymer had an Mw of 42,000.

An electrophotographic lithographic printing plate precursor was produced in the same manner as in Example 1, except for using the above prepared copolymer in place of (A-1).

COMPARATIVE EXAMPLE 3

An electrophotographic lithographic printing plate precursor was produced in the same manner as in Comparative Example 1, except for using 40 g of a butyl methacrylate/acrylic acid copolymer (99/1; Mw=45,000) as a resin binder.

Each of the lithographic printing plate precursors obtained in Example 1 and Comparative Examples 1 to 3 was evaluated for film properties in terms of surface smoothness, electrostatic characteristics, oil-desensitization of the photoconductive layer in terms of contact angle with water after oil-desensitization, and printing performances in terms of stain resistance in accordance with the following test methods.

(1) Smoothness of Photoconductive Layer:

The smoothness (sec/cc) was measured by means of a Beck smoothness tester manufactured by Kumagaya Riko K. K. under a condition of an air volume of 1 cc.

(2) Electrostatic Characteristics:

The sample was negatively charged by corona discharge to a voltage of −6 kV for 20 seconds in a dark room at 20° C. and 65% RH using a paper analyzer ("Paper Analyzer SP-428" manufactured by Kawaguchi Denki K. K.). After the sample was allowed to stand for 10 seconds, the surface potential $V_0$ was measured. Then, the photoconductive layer was irradiated with visible light at an illumination of 2.0 lux, and the time required to reduce the surface potential $V_0$ to one-tenth was measured. The exposure amount $E_{1/10}$ (lux.sec) was then calculated therefrom.

(3) Contact Angle With Water:

The sample was passed once through an etching processor using an oil-desensitizing solution ("ELP-E" produced by Fuji Photo Film Co., Ltd.) to oil-desensitize the surface of the photoconductive layer. On the thus oil-desensitized surface was placed a drop of 2 μl of distilled water, and the contact angle formed between the suface and water was measured by a goniometer.

(4) Image Quality:

The sample was allowed to stand under an ambient condition of 20° C., 65% RH (hereinafter referred to as Condition I) or a high-temperature and high-humidity condition of 30° C. and 80% RH (hereinafter referred to as Condition II) for a whole day and then processed using an automatic camera processor "ELP 404V" (manufactured by Fuji Photo Film Co., Ltd.) which had also been allowed to stand under Condition I or II, respectively. The image reproduced on the resulting printing plate was visually evaluated in terms of fog and image quality.

(5) Background Stain:

The sample was processed with ELP 404V to form a toner image, and the surface of the photoconductive layer was subjected to oil-desensitization under the same conditions as in (3) above. The resulting printing plate was mounted on an offset printing machine "Hamada Star 800SX" (manufactured by Hamada Star K. K.), and printing was carried out on fine paper in a usual manner (hereinafter referrd to as Condition I) to obtain 500 prints. All the resulting prints were visually evaluated for background stains.

The same evaluation was repeated, except that the printing was carried out under severer conditions, i.e., by using a 5-fold diluted oil-desensitizing solution and a 2-fold diluted dampening water for printing, and that the printing pressure applied was made higher (hereinafter referred to as Condition II).

In Tables 1 and 4 below, the quality of the reproduced image and the background stain were evaluated according to the following rating:

Quality of Reproduced Image

Good: clear image without background stain

Fair: slight background stains

Poor: many background stains and deficient fine lines and letters

Very Poor: substantial amount of background stains and decreased density in the image area and deficient letters Background Stain Good: no background stain Fair: slight dot-like background stains Poor: many dot-like background stains The results of these evaluations are shown in Table 1 below.

TABLE 1

| | Example 1 | Comparative Examples 1 | 2 | 3 |
|---|---|---|---|---|
| Smoothness of Photoconductive Layer (sec/cc) | 85 | 88 | 85 | 70 |
| Electrostatic Characteristics: | | | | |
| $V_0$ (−V) | 550 | 550 | 540 | 530 |
| $E_{1/10}$ (lux · sec) | 8.5 | 8.5 | 8.0 | 9.0 |
| Contact Angle with Water (degree) | 5 or less | 5 or less | 18 | 20 to 35 (widely scattered) |
| Quality of Reproduced Image: | | | | |
| Condition I | good | good | good | fair |
| Condition II | good | good | poor | very poor |
| Background Stain: | | | | |
| Condition I | good | good | good | fair |
| Condition II | more than 10,000 prints free from stains | stains observed from the 7,000th print | stains observed from the 500th print | stains observed from the start of printing |

From the results of Table 1, the following considerations can be derived.

The printing plate obtained by using any of the photosensitive material containing the resin (A) and cross-linking agent according to the present invention and the comparative photosensitive materials had a clear reproduced image, but the reproduced image of the samples of Comparative Examples 2 and 3 had considerably reduced quantity, i.e., it suffered from background fog and had a image density of 0.6 or less, when processed under a high-temperature and high-humidity condition (Condition II).

The samples of Example 1 and Comparative Example 1 showed a contact angle with water as small as 5° or less, indicating that the surface of the photoconductive layer was rendered sufficiently hydrophilic.

When each of the printing plates that forms a satisfactory reproduced image even under Condition II was used as a master plate for offset printing, only those of Example 1 and Comparative Example 1 proved excellent in resistance to background stains on the non-image area. When printing was carried out using the printing plate obtained in Example 1 or Comparative Example 1 under a higher printing pressure to obtain 10,000 prints, the 10,000th print obtained in Example 1 had satisfactory image quality and was free from background stains, whereas the plate of Comparative Example 1 caused appreciable background stains from about the 7,000th print. Further, the printing plate obtained in Comparative Example 2 caused conspicuous background stains from about 500th print.

From these facts, it is proved that only the photosensitive material according to the present invention always reproduces a clear image irrespective of a variation of environmental conditions during processing and provides a printing plate with which more than 10,000 stain-free prints can be obtained.

EXAMPLES 2 TO 17

An electrophotograpihc lithographic printing plate precursor was produced in the same manner as in Example 1, except for replacing (A-1) with each of the copolymer resins shown in Table 2 below.

TABLE 2

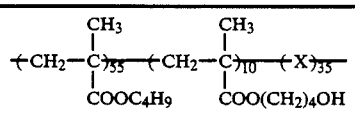

(Copolymerization ratio: % by weight)

| Example No. | Resin (A) | Copolymer Component X in Formula | Mw |
|---|---|---|---|
| 2 | A-2 | 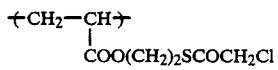 | 35,000 |
| 3 | A-3 | 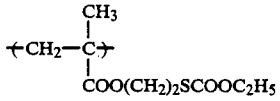 | 38,000 |
| 4 | A-4 | 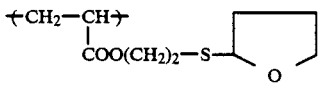 | 36,000 |
| 5 | A-5 | 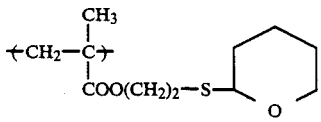 | 41,000 |

TABLE 2-continued
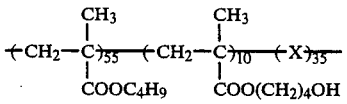
(Copolymerization ratio: % by weight)
| Example No. | Resin (A) | Copolymer Component X in Formula | Mw |
|---|---|---|---|
| 6 | A-6 | 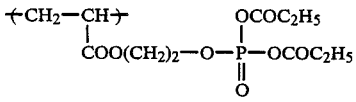 | 28,000 |
| 7 | A-7 | 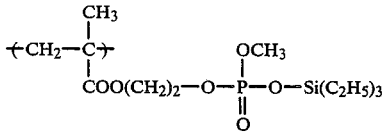 | 25,000 |
| 8 | A-8 | 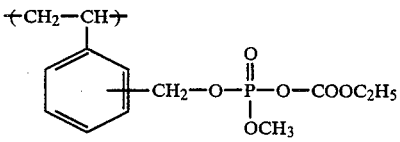 | 26,000 |
| 9 | A-9 | 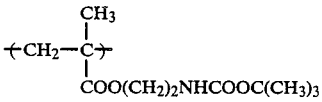 | 34,000 |
| 10 | A-10 | 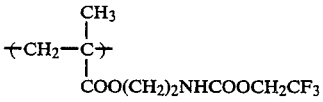 | 29,000 |
| 11 | A-11 | 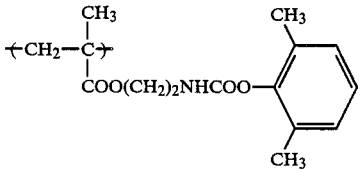 | 37,000 |
| 12 | A-12 | 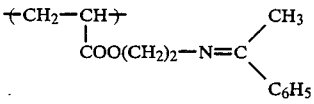 | 35,000 |
| 13 | A-13 | 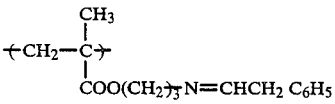 | 36,000 |
| 14 | A-14 | 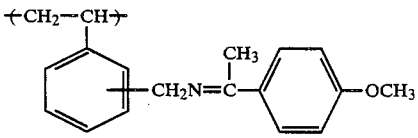 | 32,000 |
| 15 | A-15 | 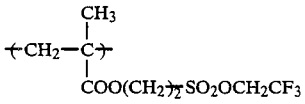 | 40,000 |

TABLE 2-continued

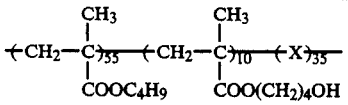

(Copolymerization ratio: % by weight)

| Example No. | Resin (A) | Copolymer Component X in Formula | Mw |
|---|---|---|---|
| 16 | A-16 | 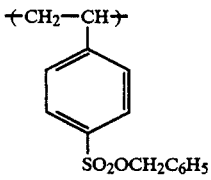 | 31,000 |
| 17 | A-17 | 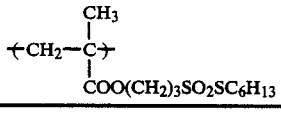 | 43,000 |

Each of the resulting printing plate precursors was processed by means of ELP 404V in the same manner as in Example 1. The resulting master plate for offset printing had a clear reproduced image having a density of 1.2 or more. After etching treatment, the master plate was used for printing. The prints after obtaining 10,000 prints had a clear image free from fog on the non-image areas.

Further, when the precursor was allowed to stand at 45° C and 75% RH and then processed in the same manner as described above, the results of printing were quite equal to those obtained above.

EXAMPLE 18

An electrophotographic lithographic printing plate precursor was prepared in the same manner as in Example 1 using a mixture having the same composition as used in Example 1, except that (A-1) was replaced with 12 g of a copolymer (A-18) having the following formula (Mw=32,000) and hexamethylene diisocyanate was used in an amount of 3 g.

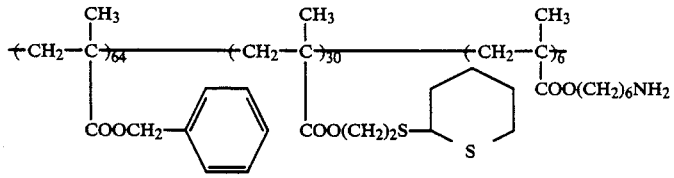

(A-18)

The printing plate precursor was processed in the same manner as in Example 1. The resulting master plate for offset printing reproduced a clear image having a density of 1.0 or more. After etching, printing was carried out by using the resulting printing plate. As a result, more than 10,000 prints having a clear image free from fog were obtained.

Further, when the printing plate precursor was allowed to stand at 45° C. and 75% RH and then processed in the same manner as above, the results of printing were entirely equal to those obtained above.

EXAMPLES 19 TO 23

An electrophotographic lithographic printing plate precursor was produced in the same mannr as in Example 1, except for replacing hexamethylene diisocyanate as used in Example 1 with each of the cross-linking agents shown in Table 3 below.

TABLE 3

| Example No. | Crosslinking Agent |
|---|---|
| 19 | ethylene glycol diglycidyl ether |
| 20 | Eponit 012 (tradename, produced by Nitto Kasei K. K.) |
| 21 | Rika Resin PO-24 (tradename, produced by New Japan Chemical Co., Ltd.) |
| 22 | diphenylmethane diisocyanate |
| 23 | triphenylmethane triisocyanate |

Each of the resulting printing plate precursors was processed in the same manner as in Example 1 and then etched. The master plate for offset printing as obtained by processing had a clear reproduced image having a density of 1.0 or more. When printing was carried out using the resulting printing plate, more than 10,000 prints having a clear image free from background fog were obtained.

EXAMPLE 24

A mixed solution consisting of 79 g of ethyl methacrylate, 20 g of a monomer compound (ii) having formula below, 1.0 g of acrylic acid, and 300 g of toluene was heated to 75° C. under a nitrogen stream, and 1.5 g of AIBN was added thereto, followed by allowing to react for 8 hours. The resulting copolymer was designated as (A-24). The copolymer (A-24) had an Mw of 43,000.

Monomer Compound (ii)

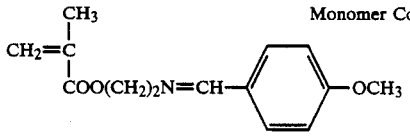

A mixed solution of 75 g of butyl methacrylate, 25 g of allyl methacrylate, and 200 g of toluene was heated to 60° C. under a nitrogen stream. One gram of 2,2'-azobis(2,4-dimethylvaleronitile) (ADMVN) was added thereto to effect reaction for 8 hours. The resulting polymer, designated as (B-1), had an Mw of 56,000.

A mixture of 25 g (as a solid content) of (A-24), 15 g (as a solid content) of (B-1), 200 g of zinc oxide, 0.05 g of Rose Bengale, 0.01 g of phthalic anhydride, and 300 g of toluene was dispersed in a ball mill for 2 hours. To the dispersion were added 10 g of allyl methacrylate and 0.5 g of ADMVN, and the mixture was further dispersed in a ball mill for 10 minutes to prepare a photosensitive coating composition. The composition was coated on paper having been rendered conductive to a dry coverage of 25 g/m$^2$ with a wire bar, followed by drying at 80° C. for 1.5 hours and then at 100° C. for 1 minute. The photosensitive layer was then allowed to stand in a dark place at 20° C. and 65% RH for 24 hours to produce an electrophotographic lithographic printing plate precursor.

COMPARATIVE EXAMPLE 4

A mixture consisting of 40 g (as a solid content) of (A-24), 200 g of zinc oxide, 0.05 g of Rose Bengale, 0.01 g of phthalic anhydride, and 300 g of toluene was dispersed in a ball mill for 2 hours to prepare a photosensitive coating composition. The composition was coated on a conductive paper support to a dry coverage of 25 g/m$^2$ with a wire bar and dried at 100° C. for 1 minute. The photosensitive layer was then allowed in a dark place at 20° C. and 65% RH for 24 hours to prepare an electrophotographic printing plate precursor.

COMPARATIVE EXAMPLE 5

A mixed solution consisting of 79 g of ethyl methacrylate, 20 g of a monomer compound (iii) shown below, 1.0 g of acrylic acid, and 200 g of toluene was subjected to polymerization reaction in the same manner as for the preparation of (A-24) of Example 24 to obtain a copolymer having an Mw of 38,000.

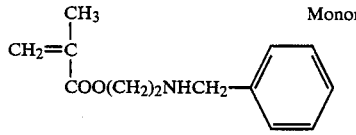

Monomer Compound (iii)

An electrophotographic printing plate precursor was produced in the same manner as in Comparative Example 4, except for using 40 g (as a solid content) of the above prepared copolymer in place of the resin used in Comparative Example 4.

COMPARATIVE EXAMPLE 6

An electrophotographic printing plate precursor was produced in the same manner as in Example 24, except for using 25 g (as a solid content) of the resin as prepared in Comparative Example 5 in place of (A-24).

Each of the printing plate precursors obtained in Example 24 and Comparative Examples 4 to 6 was evaluated in the same manner as in Example 1. The results obtained are shown in Table 4 below.

TABLE 4

| | Example 24 | Comparative Examples 4 | 5 | 6 |
|---|---|---|---|---|
| Smoothness of Photoconductive Layer (sec/cc) | 80 | 85 | 80 | 80 |
| Electrostatic Characteristics: | | | | |
| $V_0$ (−V) | 550 | 550 | 350 | 340 |
| $E_{1/10}$ (lux · sec) | 8 | 8 | 3 | 3.5 |
| Contact Angle with Water (degree) | 8 | 8 | 10 to 25 (widely scattered) | 10 to 25 (widely scattered) |
| Quality of Reproduced Image: | | | | |
| Condition I | good | good | poor (no density) | poor (no density) |
| Condition II | good | good | very poor | very poor |
| Background Stain: | | | | |
| Condition I | good | good | poor (largely uneven image) | poor (largely uneven image) |
| Condition II | more than 10,000 prints free from stains | stains observed from the 7,000th print | stains observed from the start of printing | stains observed from the start of printing |

The printing plate obtained by using any of the photosensitive material containing the resin (A) and the resin (B) according to the present invention and the photosensitive material of Comparative Example 4 had a clear reproduced image. However, the samples of Comparative Examples 5 and 6 exhibited inferior electrostatic characteristics, and the reproduced images were unacceptable due to considerably reduced density, unevenness and background fog. When each sample was processed under Condition II, and the results were compared with those obtained under Condition I, the sample of the present invention and Comparative Example 4 showed no change at all, whereas the samples of Comparative Examples 5 and 6 suffered from further deterioration of reproduced image quality.

The oil-desensitized samples of the invention and Comparative Example 4 had a contact angle with water as small as 8° or less, indicating that the surface of the photoconductive layer was rendered sufficiently hydrophilic.

When each of the printing plates was used as a master plate for offset printing, printing plates which do not cause background stains were only those of the invention and Comparative Example 4. When each of these two printing plates was used for printing under a higher printing pressure, the printing plate of Example 24 produced more than 10,000 prints having satisfactory image quality without suffering from background stains, whereas the printing plate obtained in Comparative Example 4 caused background stains from the 7,000th print.

When the sample of Example 24 was allowed to stand at 45° C. and 75% RH for 2 weeks and then evaluated for electrophotographic characteristics and printing performance properties in the same manner as in Example 1, no appreciable changes of results were observed.

From these results, it is concluded that only the light-sensitive material according to the present invention always reproduces a clear image irrespective of an environmental change during processing, thereby making it possible to obtain more than 10,000 prints free from background stains.

EXAMPLES 25 TO 41

An electrophotographic lithographic printing plate precursor was produced in the same manner as in Example 24, except for replacing (A-24) with 25 g of each of the copolymers shown in Table 5 below.

TABLE 5

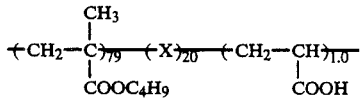

(Copolymerization Ratio: % by weight)

| Example No. | Resin (A) | X in Formula Above | Mw |
|---|---|---|---|
| 25 | A-25 | 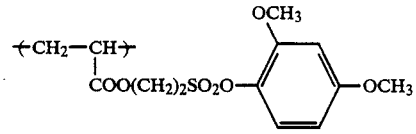 | 34,000 |
| 26 | A-26 | 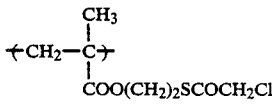 | 36,000 |
| 27 | A-27 | 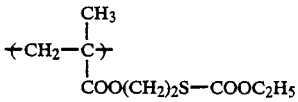 | 28,000 |
| 28 | A-28 | 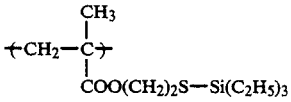 | 37,000 |
| 29 | A-29 | 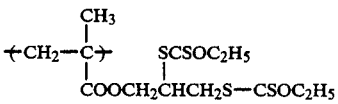 | 21,000 |
| 30 | A-30 | 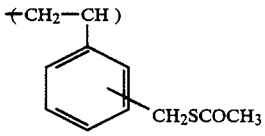 | 23,000 |
| 31 | A-31 | 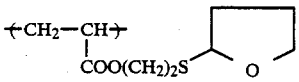 | 35,000 |
| 32 | A-32 | 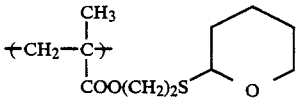 | 41,000 |
| 33 | A-33 | 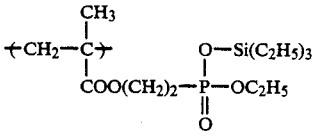 | 33,000 |
| 34 | A-34 | 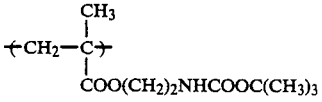 | 38,000 |

TABLE 5-continued

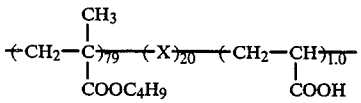

(Copolymerization Ratio: % by weight)

| Example No. | Resin (A) | X in Formula Above | Mw |
|---|---|---|---|
| 35 | A-35 | 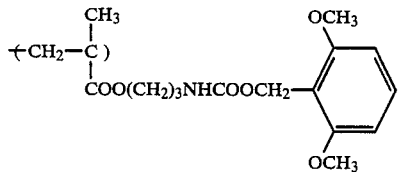 | 27,000 |
| 36 | A-36 | 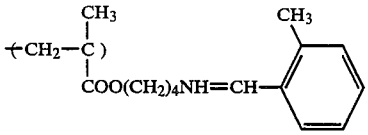 | 35,000 |
| 37 | A37 | 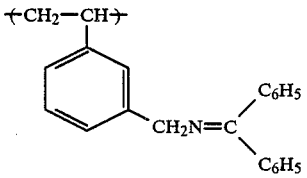 | 23,000 |
| 38 | A-38 | 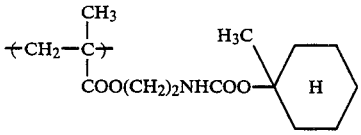 | 24,000 |
| 39 | A-39 | 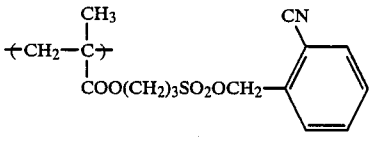 | 32,000 |
| 40 | A-40 | 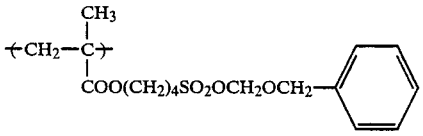 | 34,000 |
| 41 | A-41 | 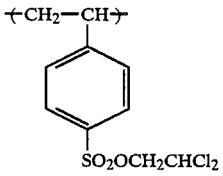 | 29,000 |

Each of the printing plate precursors was processed by means of the same processor as used in Example 1. The resulting master plate for offset printing had a clear image having a density of 1.0 or more. After etching treatment, printing was carried out using the resulting printing plate. As a result, more than 10,000 clear prints free from fog were obtained.

Further, the printing plate precursor was allowed to stand at 45° C. and 75% RH for 2 weeks and then processed in the same manner as above. The results of printing were entirely equal to those obtained above.

EXAMPLES 42 to 47

A printing plate precursor was prepared in the same manner as in Example 24, except for replacing (B-1) with 15 g of each of the copolymers shown in Table 6 below.

TABLE 6

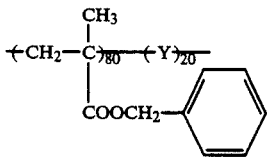

| Example No. | Resin (B) | Structure of Resin (Y) | Mw |
|---|---|---|---|
| 42 | B-2 | 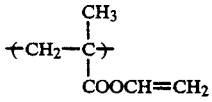 | 43,000 |
| 43 | B-3 | 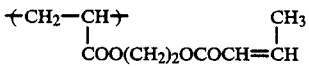 | 44,000 |
| 44 | B-4 | 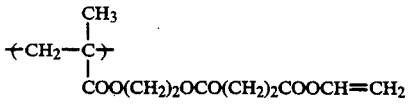 | 38,000 |
| 45 | B-5 | 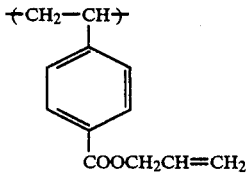 | 25,000 |
| 46 | B-6 | 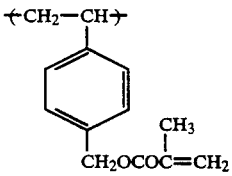 | 23,000 |
| 47 | B-7 | 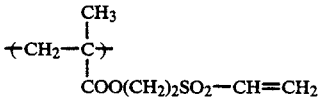 | 33,000 |

The precursor was processed by means of the same processor as used in Example 1. The resulting master plate for offset prining had a clear image having a density of 1.0 or more in any case. After etching, printing was performed. As a result, more than 10,000 prints having a clear image without fog were obtained.

EXAMPLE 48

A mixture having the same composition as used in Example 24, except for containing 15 g of a copolymer (B-8) (Mw=20,000) shown below in place of (B-1) was dispersed in a ball mill for 2 hours to prepare a photosensitive coating composition (addition of ADMVN was omitted).

Copolymer (B-8)

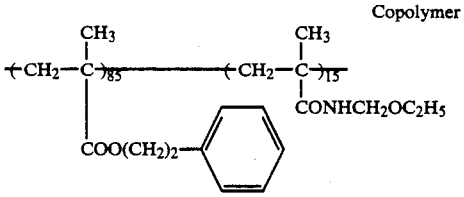

The resulting coating composition was coated on paper having been rendered electrically conductive with a wire bar coator to a dry coverage of 25 g/m$^2$ and dried at 105° C. for 2 hours. The thus formed photoconductive layer was allowed to stand in a dark place at 20° C. and 65% RH for 24 hours to obtain an electrophotographic lithographic printing plate precursor.

The resulting printing plate precursor was processed by means of the same processor as used in Example 1. The resulting master plate for offset printing had a clear image having a density of 1.0 or more. After etching, printing was carried out by using the resulting printing plate. There were obtained more than 10,000 clear prints free from fog.

When the precursor was processed after being allowed to stand at 45° C. and 75% RH and printing was carried out in the same manner, the results obtained were quite the same as those obtained above.

EXAMPLE 49

An electrophotographic printing plate precursor was prepared in the same manner as in Example 48, except for replacing (B-8) with 8 g of a copolymer shown below (C-1) and 7 g of a copolymer (B-9) shown below.

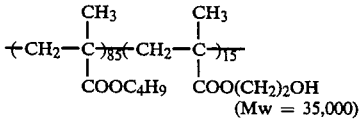
Copolymer (C-1)
(Mw = 35,000)

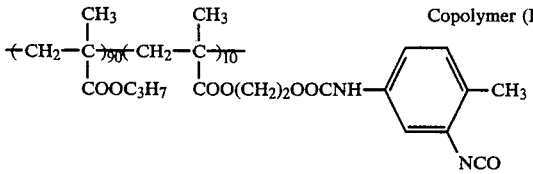
Copolymer (B-9)
(Mw = 21,000)

The precursor was processed by means of the same processor as used in Example 1. After the processing, the resulting master plate for offset printing had a density of 1.0 or more and a clear image. After etching treatment, printing was carried out. As a result, more than 10,000 clear prints free from background fog were obtained.

EXAMPLES 50 TO 51

An electrophotographic lithographic printing plate precursor was prepared in the same manner as in Example 49, except for replacing (C-1) with 7 g of each of copolymers shown below. Copolymer (C-2):

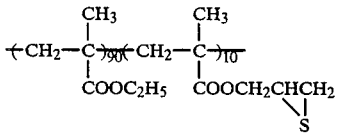
Copolymer (C-2)
(Mw = 40,000)

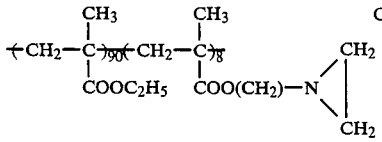
Copolymer (C-3)
(Mw = 35,000)

When the precursor was processed with the same processor as used in Example 1, the resulting master plate for offset printing had a density of 1.0 or more and a clear image. After etching treatment, printing was carried out. As a result, more than 10,000 clear prints free from fog were obtained.

As described above, the electrophotographic lithographic printing plate precursor according to the present invention provides a printing plate excellent in resistance to background stains and printing durability.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor obtained from an electrophotographic photoreceptor comprising a conductive support having provided thereon at least one photoconductive layer containing photoconductive zinc oxide and a resin binder, wherein said resin binder comprises (1) at least one resin (A) containing at least one functional group capable of forming at least one hydrophilic group selected from a thiol group, a phosphono group, an amino group and a sulfo group upon decomposition by treatment with an oil-desensitizing solution or dampening water and (2) at least one of a heat-curable or photo-curable resin (B) or a crosslinking agent (C).

2. An electrophotographic lithographic printing plate precursor as in claim 1, wherein said resin (A) is a resin containing at least one functional group capable of forming at least one thiol group on decomposition, said functional group being represented by formula (I)

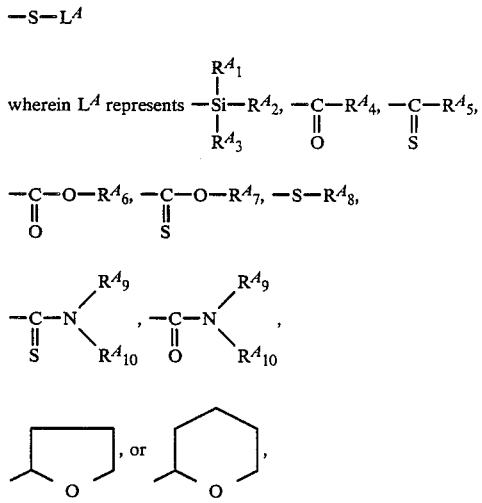
(I)

wherein $R^{A}_1$, $R^{A}_2$, and $R^{A}_3$ each represents a hydrocarbon group or —O—$R^{A'}$, wherein $R^{A'}$ represents a hydrocarbon group; and $R^{A}_4$, $R^{A}_5$, $R^{A}_6$, $R^{A}_7$, $R^{A}_8$, $R^{A}_9$, and $R^{A}_{10}$ each represents a hydrocarbon group.

3. An electrophotographic lithographic printing plate precursor as in claim 1, wherein said resin (A) is a resin containing at least one thiirane ring capable of forming at least one thiol group on decomposition, said thiirane ring being selected from a group represented by formula (II)

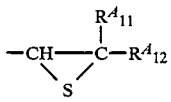
(II)

wherein $R^{A}_{11}$ and $R^{A}_{12}$ each represents a hydrogen atom or a hydrocarbon group; and a group represented by formula (III)

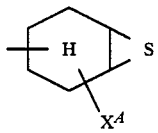
(III)

wherein $X^{A}$ represents a hydrogen atom or an aliphatic group.

4. An electrophotographic ilthographic printing plate precursor as in claim 1, wherein said resin (A) is a resin containing at least one sulfur-containing heterocyclic group capable of forming at least one thiol group on decomposition, said heterocyclic group being represented by formula (IV)

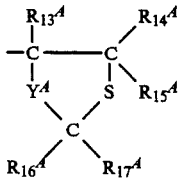

(IV)

wherein $Y^A$ represents an oxygen atom or —NH—; $R^A{}_{13}'$ $R^A{}_{14}$, and $R^A{}_{15}$, which may be the same or different, each represents a hydrogen atom or a hydrocarbon group, $R^A{}_{16}$ and $R^A{}_{17}$, which may be the same or different, each represents a hydrogen atom, a hydrocarbon group, or —O—$R^{A''}$, wherein $R^{A''}$ represents a hydrocarbon group.

5. An electrophotographic lithographic printing plate precursor as in claim 1, wherein said resin (A) is a resin containing at least one functional group capable of forming a thiol group on decomposition, in which at least two thiol groups sterically spaced close to each other are protected with one protective group.

6. An electrophotographic lithographic printing plate precursor as in claim 5, wherein said functional group is selected from a group represented by formula (V)

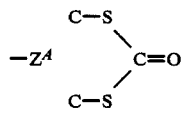

(V)

wherein $Z^A$ represents a carbon-carbon bond which may contain a hetero atom or a chemical bond directly connecting the C-S bonds, provided that the number of atoms between two sulfur atoms is 4 or less, or either one of the groups ($Z^A$ . . . C) represents a chemical bond; a group represented by formula (VI)

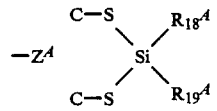

(VI)

wherein $Z^A$ is the same as defined above; and $R^A{}_{18}$ and $R^A{}_{19}$, which may be the same or different, each represents a hydrogen atom, a hydrocarbon group, or —O—$R^{A''}$, where $R^{A''}$ represents a hydrocarbon group; and a group represented by formula (VII)

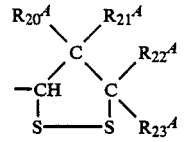

(VII)

wherein $R^A{}_{20}$, $R^A{}_{21}$, $R^A{}_{22}$, and $R^A{}_{23}$ each represents a hydrogen atom or a hydrocarbon group.

7. An electrophotographic lithographic printing plate precursor as in claim 1, wherein said resin (A) is a resin containing at least one functional group capable of forming at least one phosphono group on decomposition, said functional group being selected from a group represented by formula (X)

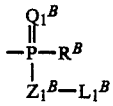

(X)

wherein $R^B$ represents a hydrocarbon group or —$Z^B{}_2$—$R^{B'}$, wherein $R^{B'}$ represents a hydrocarbon group, and $Z^B{}_2$ represents an oxygen atom or a sulfur atom; $Q^B{}_1$ represents an oxygen atom or a sulfur atom; $Z^B{}_1$ represents an oxygen atom or a sulfur atom; and $L^B{}_1$ represents

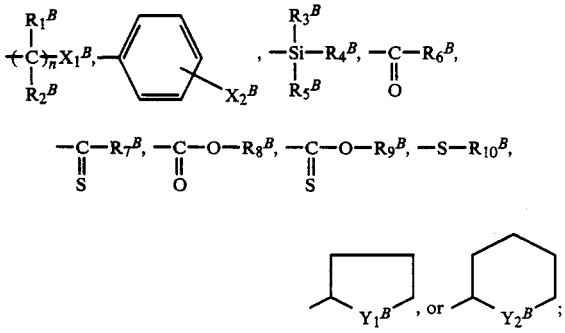

wherein $R^B{}_1$ and $R^B{}_2$ each represents a hydrogen atom, a halogen atom or a methyl group; $X^B{}_1$ and $X^B{}_2$ each represents an electron attracting substituent; and n represents 1 or 2; provided that when $X^B{}_1$ represents a methyl group, $R^B{}_1$ and $R^B{}_2$ each represents a methyl group and n represents 1; $R^B{}_3$, $R^B{}_4$, and $R^B{}_5$ each represents a hydrogen atom, a hydrocarbon group, or —O—$R^{B'''}$, wherein $R^{B'''}$ represents a hydrocarbon group; $R^B{}_6$, $R^B{}_7$, $R^B{}_8$, $R^B{}_9$, and $R^B{}_{10}$ each represents a hydrocarbon group; and $Y^B{}_1$ and $Y^B{}_2$ each represents an oxygen atom or a sulfur atom; and a group represented by formula (XI)

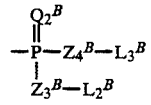

(XI)

wherein $Q^B{}_2$, $Z^B{}_3$, and $Z^B{}_4$ each represents an oxygen atom or a sulfur atom; and $L^B{}_2$ and $L^B{}_3$ each has the same meaning as $L^B{}_1$ in formula (X).

8. An electrophotographic lithographic printing plate precursor as in claim 1, wherein said resin (A) is a resin containing at least one functional group capable of forming at least one amino group on decomposition, said functional group being selected from a group represented by formula (XII)

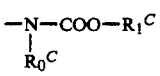

(XII)

wherein $R^C{}_0$ represents a hydrogen atom, a substituted or unsubstituted alkyl group having from 1 to 12 carbon atoms, an alicyclic group having from 5 to 8 carbon atoms, a substituted or unsubstituted aralkyl group having from 7 to 12 carbon atoms, a substituted or unsubstituted aryl group having from 6 to 12 carbon atoms; and $R^C{}_1$ represents a substituted or unsubstituted aliphatic group having from 2 to 12 carbon atoms; a group represented by formula (XIII)

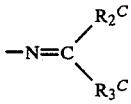

(XIII)

wherein $R^{C}_2$ and $R^{C}_3$ each represents a hydrocarbon group having from 1 to 12 carbon atoms; and a group represented by formula (XIV)

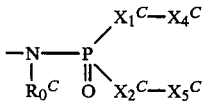

(XIV)

wherein $X^{C}_1$ and $X^{C}_2$ each represents an oxygen atom or a sulfur atom; and $X^{C}_4$ and $X^{C}_5$ each represents a hydrocarbon group having from 1 to 8 carbon atoms.

9. An electrophotographic lithographic printing plate precursor as in claim 1, wherein said resin (A) is a resin containing at least one functional group capable of forming at least one sulfo group on decomposition, said functional group being selected from a group represented by formula (XVI)

$$-SO_2-O-R^{D}_1 \quad \text{(XVI)}$$

wherein $R^{D}_1$ represents

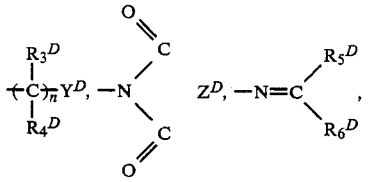

or $-NHCOR^{D}_7$, wherein $R^{D}_3$ and $R^{D}_4$ each represents a hydrogen atom, a halogen atom, an alkyl group having from 1 to 6 carbon atoms, or an aryl group; $Y^{D}$ represents a substituted or unsubstituted alkyl group having from 1 to 18 carbon atoms, a substituted or unsubstituted alkenyl group having from 2 to 18 carbon atoms, a substituted or unsubstituted aryl group having from 6 to 12 carbon atoms, or

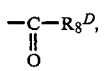

wherein $R^{D}_8$ represents an aliphatic or aromatic group; n represents 0, 1 or 2; $Z^{D}$ represents an organic residual group forming a cyclic imido group; $R^{D}_5$ and $R^{D}_6$ each represents a hydrogen atom, an aliphatic group, or an aryl group, provided that they do not both represent a hydrogen atom; and $R^{D}_7$ represents an aliphatic group or an aryl group; and a group represented by formula (XVII)

$$-SO_2-S-R^{D}_2 \quad \text{(XVII)}$$

wherein $R^{D}_2$ represents a substituted or unsubstituted aliphatic group having from 1 to 18 carbon atoms or a substituted or unsubstituted aryl group having from 6 to 22 carbon atoms.

10. An electrophotographic lithographic printing plate precursor as in claim 1, wherein said resin (A) comprises a copolymer component represented by formula (A)

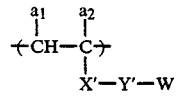

wherein X' represents —O—, —CO—, —COO—, —OCO—,

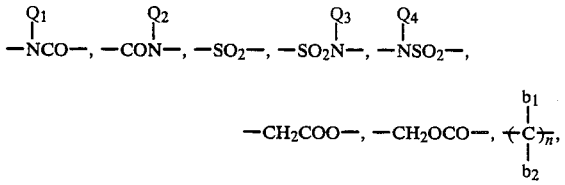

aromatic group, or a heterocyclic group, wherein $Q_1$, $Q_2$, $Q_3$, and $Q_4$ each represents a hydrogen atom, a hydrocarbon group, or the group —Y'—W in formula (A); $b_1$ and $b_2$ each represents a hydrogen atom, a hydrocarbon group, or the group —Y'—W in formula (A); and n represents 0 or an integer of from 1 to 18; Y' represents a carbon-carbon bond, which may contain a hetero atom, for linking X' and W; $a_1$ and $a_2$ each represents a hydrogen atom, a halogen atom, a cyano group, or a hydrocarbon group, or —X'—Y' represents a chemical bond directly connecting C and W; and W represents a functional group capable of forming at least one hydrophilic group selected from a thiol group, a phosphono group, an amino group, and a sulfo group on decomposition.

11. An electrophotographic lithographic printing plate precursor as in claim 1, wherein said resin (A) contains the copolymer component represented by formula (A) in a proportion of from 0.1 to 95% by weight.

12. An electrophotographic lithographic printing plate precursor as in claim 1, wherein said resin (A) contains a copolymer component crosslinkable with at least one of the resin (B) and the crosslinking agent (C).

13. An electrophotographic lithographic printing plate precursor as in claim 1, wherein said resin (B) is a resin crosslinkable with the functional group of the resin (A).

14. An electrophotographic lithographic printing plate precursor as in claim 1, wherein the weight ratio of the resin (A) to resin (B) is from 5/95 to 80/20.

15. An electrophotographic lithographic printing plate precursor as in claim 1, wherein said crosslinking agent is present in an amount of from 0.1 to 30% by weight based on the resin binder.

16. An electrophotographic lithographic printing plate precursor as in claim 1, wherein said resin binder comprises at least one resin (A) and at least one crosslinking agent (C).

* * * * *